US008081124B2

(12) United States Patent
Yagi

(10) Patent No.: US 8,081,124 B2
(45) Date of Patent: Dec. 20, 2011

(54) PLANAR MONOPOLE ANTENNA AND ELECTRONIC DEVICE

(75) Inventor: Shigeru Yagi, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 327 days.

(21) Appl. No.: 12/343,989

(22) Filed: Dec. 24, 2008

(65) Prior Publication Data

US 2009/0167619 A1 Jul. 2, 2009

(30) Foreign Application Priority Data

Dec. 27, 2007 (JP) ..... 2007-337533

(51) Int. Cl.
*H01Q 1/24* (2006.01)

(52) U.S. Cl. ..... 343/702; 343/700 MS

(58) Field of Classification Search ..... 343/700 MS, 343/702, 745, 749
See application file for complete search history.

(56) References Cited

U.S. PATENT DOCUMENTS

| | | | | |
|---|---|---|---|---|
| 5,926,150 | A | 7/1999 | McLean et al. | |
| 6,421,014 | B1 | 7/2002 | Sanad | |
| 6,529,170 | B1 | 3/2003 | Nishizawa et al. | |
| 6,600,448 | B2 | 7/2003 | Ikegaya et al. | |
| 6,621,464 | B1 | 9/2003 | Fang et al. | |
| 6,847,328 | B1 * | 1/2005 | Libonati et al. | 343/700 MS |
| 6,853,336 | B2 | 2/2005 | Asano et al. | |
| 6,870,504 | B2 | 3/2005 | Ikegaya et al. | |
| 6,906,677 | B2 | 6/2005 | Yamamoto et al. | |
| 6,917,333 | B2 | 7/2005 | Ikegaya et al. | |
| 7,176,843 | B2 | 2/2007 | Shimasaki et al. | |
| 7,248,224 | B2 | 7/2007 | Yuanzhu | |
| 7,265,720 | B1 | 9/2007 | Ponce De Leon et al. | |
| 7,372,406 | B2 * | 5/2008 | Shiotsu et al. | 343/700 MS |
| 7,375,686 | B2 | 5/2008 | Ku et al. | |
| 7,389,129 | B2 | 6/2008 | Shoji | |
| 7,423,598 | B2 | 9/2008 | Bit-Babik et al. | |
| 7,612,720 | B2 | 11/2009 | Kerselaers | |

(Continued)

FOREIGN PATENT DOCUMENTS

DE 101 47 921 A1 4/2003

(Continued)

OTHER PUBLICATIONS

Japanese Office Action dated Mar. 9, 2010 and English translation thereof in counterpart Japanese Application No. 2007-337533.

(Continued)

*Primary Examiner* — Dieu H Duong
(74) *Attorney, Agent, or Firm* — Holtz, Holtz, Goodman & Chick, PC

(57) ABSTRACT

Disclosed is a planar monopole antenna including: a film formed of an insulating material; an antenna element which is a single-body planar conductor on the film; and a ground element which is a planar conductor on the film and kept at ground potential, wherein the antenna element includes: a first pole element which is formed of a planar body of a conductive material and has a feeding point; a capacitor element having a capacitor component and a coil element having a coil component, each of which is formed of a planar body of a conductive material and formed integral with the first pole element; and a second pole element which is formed of a planar body of a conductive material and formed integral with the capacitor element and the coil element.

3 Claims, 16 Drawing Sheets

U.S. PATENT DOCUMENTS

| | | | | |
|---|---|---|---|---|
| 7,777,682 | B2 | 8/2010 | Yagi | |
| 7,864,115 | B2 | 1/2011 | Yamazaki et al. | |
| 7,889,139 | B2 | 2/2011 | Hobson et al. | |
| 2003/0045324 | A1 | 3/2003 | Nagumo et al. | |
| 2004/0137971 | A1 | 7/2004 | Shoji | |
| 2004/0201528 | A1 | 10/2004 | Lee et al. | |
| 2004/0217916 | A1 | 11/2004 | Quintero Illera et al. | |
| 2004/0222936 | A1 | 11/2004 | Hung et al. | |
| 2004/0246188 | A1 | 12/2004 | Egashira | |
| 2005/0035919 | A1 | 2/2005 | Yang et al. | |
| 2005/0200556 | A1 | 9/2005 | Lin et al. | |
| 2005/0212706 | A1 | 9/2005 | Ying et al. | |
| 2005/0280579 | A1 * | 12/2005 | Liang et al. | 343/700 MS |
| 2006/0001590 | A1 | 1/2006 | Hung et al. | |
| 2006/0017643 | A1 | 1/2006 | Shimasaki et al. | |
| 2006/0022888 | A1 | 2/2006 | Cheng | |
| 2006/0132362 | A1 | 6/2006 | Yuanzhu | |
| 2006/0170605 | A1 | 8/2006 | Tang et al. | |
| 2006/0187135 | A1 | 8/2006 | Maniwa et al. | |
| 2006/0208950 | A1 | 9/2006 | Tago | |
| 2007/0040751 | A1 | 2/2007 | Boyle | |
| 2007/0052610 | A1 | 3/2007 | Lee | |
| 2007/0103367 | A1 | 5/2007 | Wang | |
| 2007/0268190 | A1 | 11/2007 | Huynh | |
| 2008/0180339 | A1 | 7/2008 | Yagi | |
| 2008/0180342 | A1 | 7/2008 | Kerselaers | |
| 2008/0284662 | A1 | 11/2008 | Yagi | |
| 2008/0316121 | A1 | 12/2008 | Hobson et al. | |
| 2009/0295652 | A1 | 12/2009 | Yagi et al. | |
| 2010/0302111 | A1 | 12/2010 | Kotaka et al. | |

FOREIGN PATENT DOCUMENTS

| | | | |
|---|---|---|---|
| DE | 20 2006 019 045 | U1 | 3/2007 |
| EP | 1 345 282 | B1 | 1/2006 |
| EP | 1 617 514 | A1 | 1/2006 |
| JP | 63-254803 | A | 10/1988 |
| JP | 10-093332 | A | 4/1998 |
| JP | 2001-185938 | A | 7/2001 |
| JP | 2002-055733 | A | 2/2002 |
| JP | 2003-078333 | A | 3/2003 |
| JP | 2004-072605 | A | 3/2004 |
| JP | 2004-159029 | A | 6/2004 |
| JP | 2004-356823 | A | 12/2004 |
| JP | 3622959 | B2 | 2/2005 |
| JP | 2005-130249 | A | 5/2005 |
| JP | 3656610 | B2 | 6/2005 |
| JP | 2005-284516 | A | 10/2005 |
| JP | 2005-286915 | A | 10/2005 |
| JP | 2006-067234 | A | 3/2006 |
| JP | 2006-180150 | A | 7/2006 |
| JP | 2006-254081 | A | 9/2006 |
| JP | 3830358 | B2 | 10/2006 |
| JP | 2006-529070 | T | 12/2006 |
| JP | 2007-13596 | A | 1/2007 |
| JP | 2007-027906 | A | 2/2007 |
| JP | 2007-043594 | A | 2/2007 |
| JP | 2007-124346 | A | 5/2007 |
| JP | 2008-502205 | T | 1/2008 |
| WO | WO 01/15270 | A1 | 3/2001 |
| WO | WO 2004/097980 | A1 | 11/2004 |
| WO | WO 2006/114724 | A1 | 11/2006 |

OTHER PUBLICATIONS

U.S. Appl. No. 12/011,952; First Named Inventor: Shigeru Yagi; Title: "Plane Circular Polarization Antenna and Electronic Apparatus"; filed Jan. 30, 2008, published as US 2008/0180339, and issued as USP 7,777,682.

U.S. Appl. No. 12/117,042; First Named Inventor: Shigeru Yagi; Title: "Film Antenna and Electronic Equipment"; filed May 8, 2008, published as US 2008/0284662.

U.S. Appl. No. 12/473,680; First Named Inventor: Shigeru Yagi; Title: "Planar Antenna and Electronic Device"; filed May 28, 2009, published as US 2009/0295652.

U.S. Appl. No. 12/776,583; First Named Inventor: Yuki Kotaka; Title: "Multiband Planar Antenna and Electronic Equipment"; filed May 10, 2010.

Extended European Search Report dated Apr. 16, 2009 (4 pages), issued in counterpart European Application Serial No. 08021474.5.

Japanese Office Action dated Mar. 29, 2011 (and English translation thereof) issued in a Japanese counterpart (Application No. 2009-127122) of related U.S. Appl. No. 12/776,583.

* cited by examiner

FIG. 2C
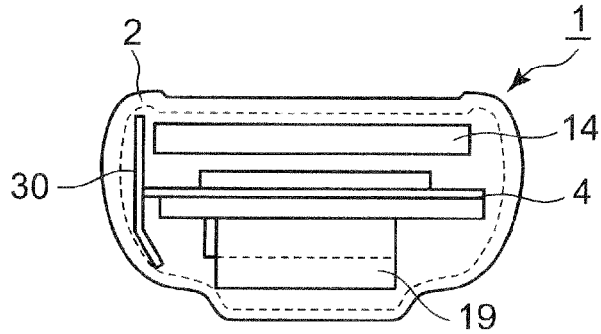
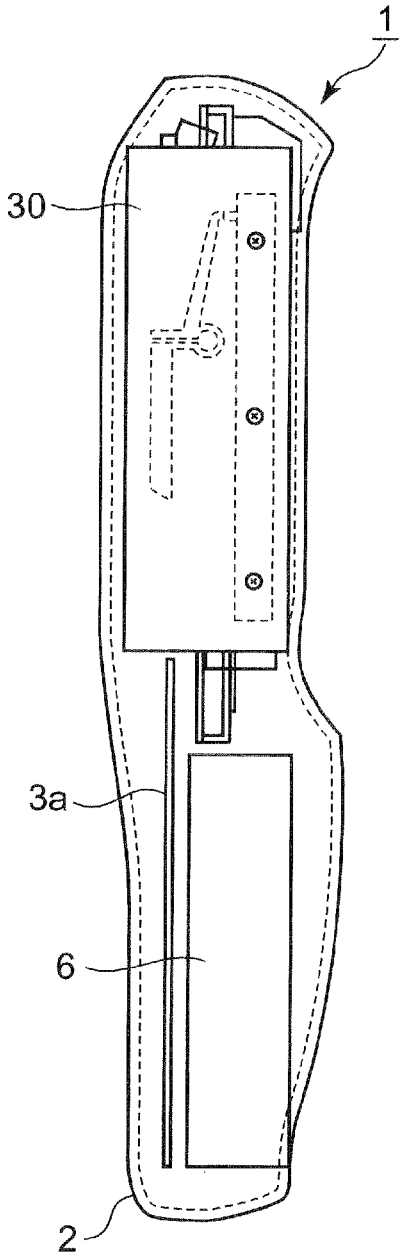
FIG. 2B
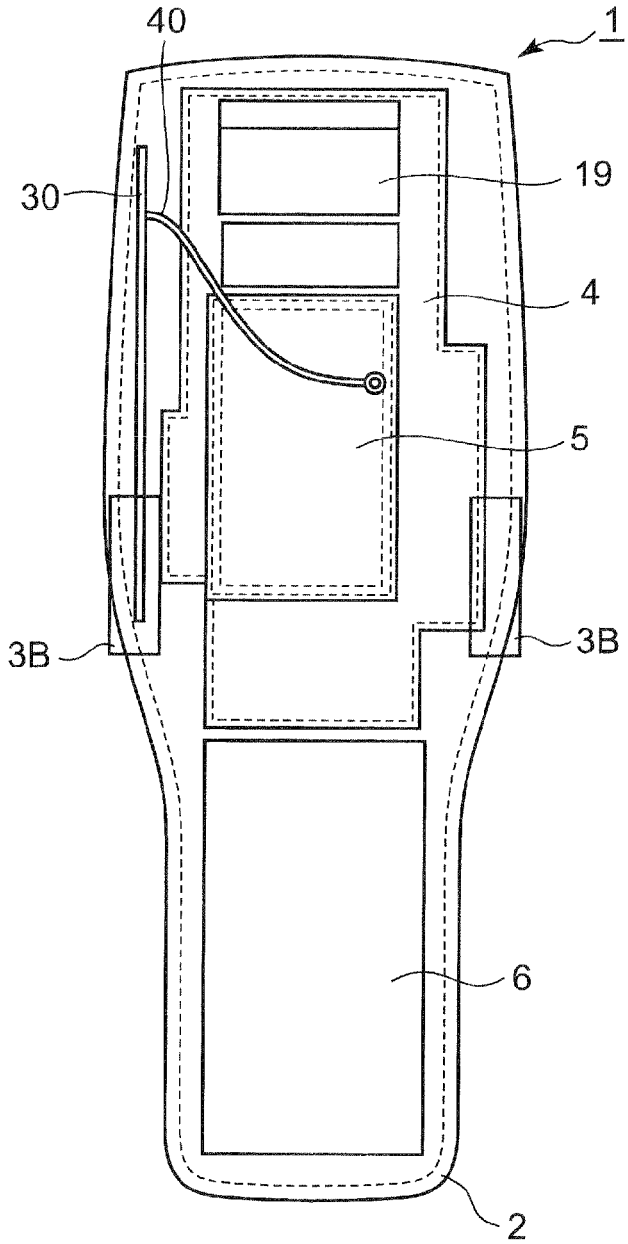
FIG. 2A

PLANAR MONOPOLE ANTENNA AND ELECTRONIC DEVICE

BACKGROUND OF THE INVENTION

1. Field of the Invention

The present invention relates to a planar monopole antenna and an electronic device.

2. Description of Related Art

In recent years, portable terminals having wireless communication functions, such as handy terminal and PDA (Personal Digital Assistant), have become known to a wide public.

Small-size multi-band antennas capable of sending and receiving wireless signals at a plurality of frequency bands have been known to those skilled in the art. Conventional multi-band antenna is provided with a plurality of antenna elements which resonate at required frequencies to allow a multi-band resonance (for example, see JP-A-2007-13596).

In a large-size monopole antenna, a trap coil is provided at a middle portion of a rod antenna to realize a plurality of resonance frequencies. The trap coil, which is a separate component from the rod antenna, includes a coil and capacitor.

Nowadays, there is a need to use multi-band antennas for wireless communications using portable terminals. However, because the above-described conventional multi-band antenna needs a plurality of antenna elements, a size and an area of the antenna have to be relatively large.

Moreover, assuming that a structure of the above-described conventional monopole antenna provided with a trap coil is applied to a planar film antenna, an additional component separate from the film antenna is required to realize a multi-band antenna. Therefore, it is difficult to attach the component to the film antenna.

Another possible planar antenna may be provided with a plurality of elements in parallel to realize a multi-band antenna. In such a multi-band antenna, however, the distance from a ground plane varies from element to element. Therefore, since impedance depends on frequency, it is difficult to obtain impedance matching properly.

SUMMARY OF THE INVENTION

It is, therefore, a main object of the present invention to provide a small-size easily-manufactured multi-band antenna that allows appropriate impedance matching.

According to a first aspect of the present invention, there is provided a planar monopole antenna including: a film formed of an insulating material; an antenna element which is a single-body planar conductor on the film; and a ground element which is a planar conductor on the film and kept at ground potential, wherein the antenna element includes: a first pole element which is formed of a planar body of a conductive material and has a feeding point; a capacitor element having a capacitor component and a coil element having a coil component, each of which is formed of a planar body of a conductive material and formed integral with the first pole element; and a second pole element which is formed of a planar body of a conductive material and formed integral with the capacitor element and the coil element.

According to a second aspect of the present invention, there is provided an electronic device including: an antenna; a communication unit to perform wireless communication using the antenna; and a control unit to control the communication unit, wherein the antenna is a planar monopole antenna including: a film formed of an insulating material; an antenna element which is a single-body planar conductor on the film; and a ground element which is a planar conductor on the film and kept at ground potential, wherein the antenna element includes: a first pole element which is formed of a planar body of a conductive material and has a feeding point; a capacitor element having a capacitor component and a coil element having a coil component, each of which is formed of a planar body of a conductive material and formed integral with the first pole element; and a second pole element which is formed of a planar body of a conductive material and formed integral with the capacitor element and the coil element.

According to the present invention, it is possible to realize a small-size easily-manufactured multi-band antenna that allows appropriate impedance matching.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 2A shows a perspective back view of the handy terminal;

FIG. 2B shows a perspective side view of the handy terminal;

FIG. 2C shows a perspective top view of the handy terminal;

DETAILED DESCRIPTION OF THE PREFERRED EMBODIMENT

Figure 1:
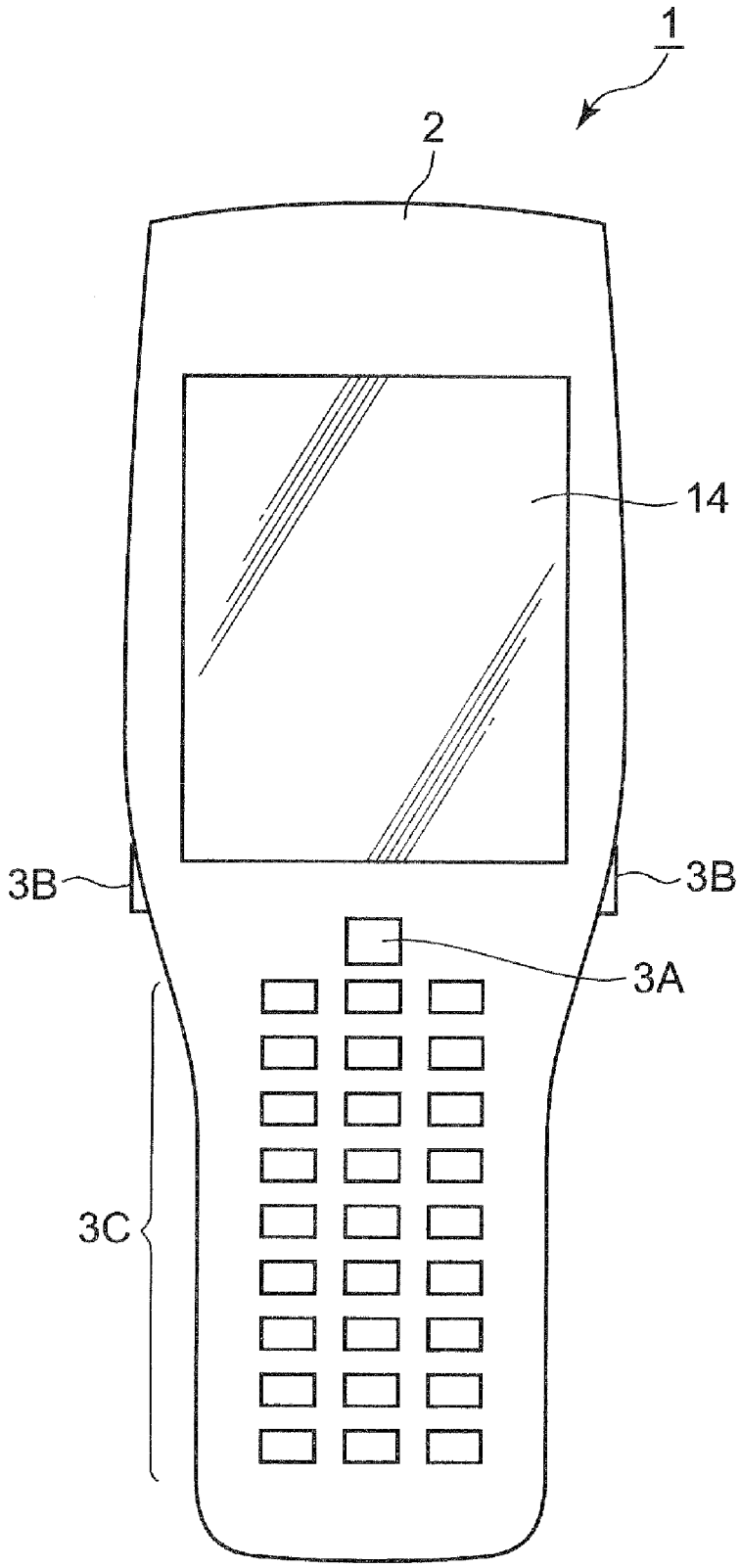
FIG. 1 shows an elevation view of a handy terminal according to a preferred embodiment of the present invention.

A preferred embodiment of the present invention and first to tenth modifications will be explained below in detail with reference to the drawings. The present invention is not to be considered limited to what is shown in the drawings and the following detailed description. The same reference numerals will be used throughout the drawings and the detailed description to refer to the same elements.

The embodiment according to the present invention will be described with reference to FIGS. 1 to 10. First, a device configuration of the embodiment will be explained with reference to FIGS. 1 to 6.

FIG. 1 shows an elevation view of a handy terminal 1 according to the embodiment. FIG. 2A shows a perspective back view of the handy terminal 1. FIG. 2B shows a perspective side view of the handy terminal 1. FIG. 2C shows a perspective top view of the handy terminal 1.

The handy terminal 1 as an electronic device according to the embodiment is a portable terminal having functions of entering information by a user, storing information, scanning a bar code, etc. Specifically, the handy terminal 1 has a wireless communication function with an external device through an access point via a wireless LAN (Local Area Network) and a communication function via a mobile telephone communication such as GSM (Global System for Mobile Communication).

As shown in FIG. 1, the handy terminal 1 includes a display unit 14, a trigger key 3A and various keys 3C on a front of a case 2. The handy terminal 1 also includes trigger keys 3B on both sides of the case 2. The trigger keys 3A and 3B are keys for accepting a trigger to emit an optical signal by a scanning unit 19 (described later). The keys 3C includes character input keys for inputting characters such as numerals and function keys for accepting inputs of various functions such as mode switching.

As shown in FIGS. 2A, 2B and 2C, the handy terminal 1 has a planar monopole antenna 30, a coaxial cable 40, a main board 4, a GSM module 5, a battery 6, a key board 3*a* and the scanning unit 19 inside the terminal.

The respective units of the handy terminal 1 are connected to the main board 4. The planar monopole antenna 30 is used for the cellular phone communication described above. The planar monopole antenna 30 is fixed by screws. The planar monopole antenna 30 will be described in detail later. The GSM module 5 is a module for the cellular phone communication, and is connected to the planar monopole antenna 30 through the coaxial cable 40.

The scanning unit 19 emits a beam of light that reflects off a bar code, and digitalizes the reflected light to read data of the bar code. The battery 6 is for supplying power to the handy terminal 1. The trigger key 3A and the keys 3C are provided on the key board 3*a*. The input signals by these keys are sent to the main board 4.

Figure 3:
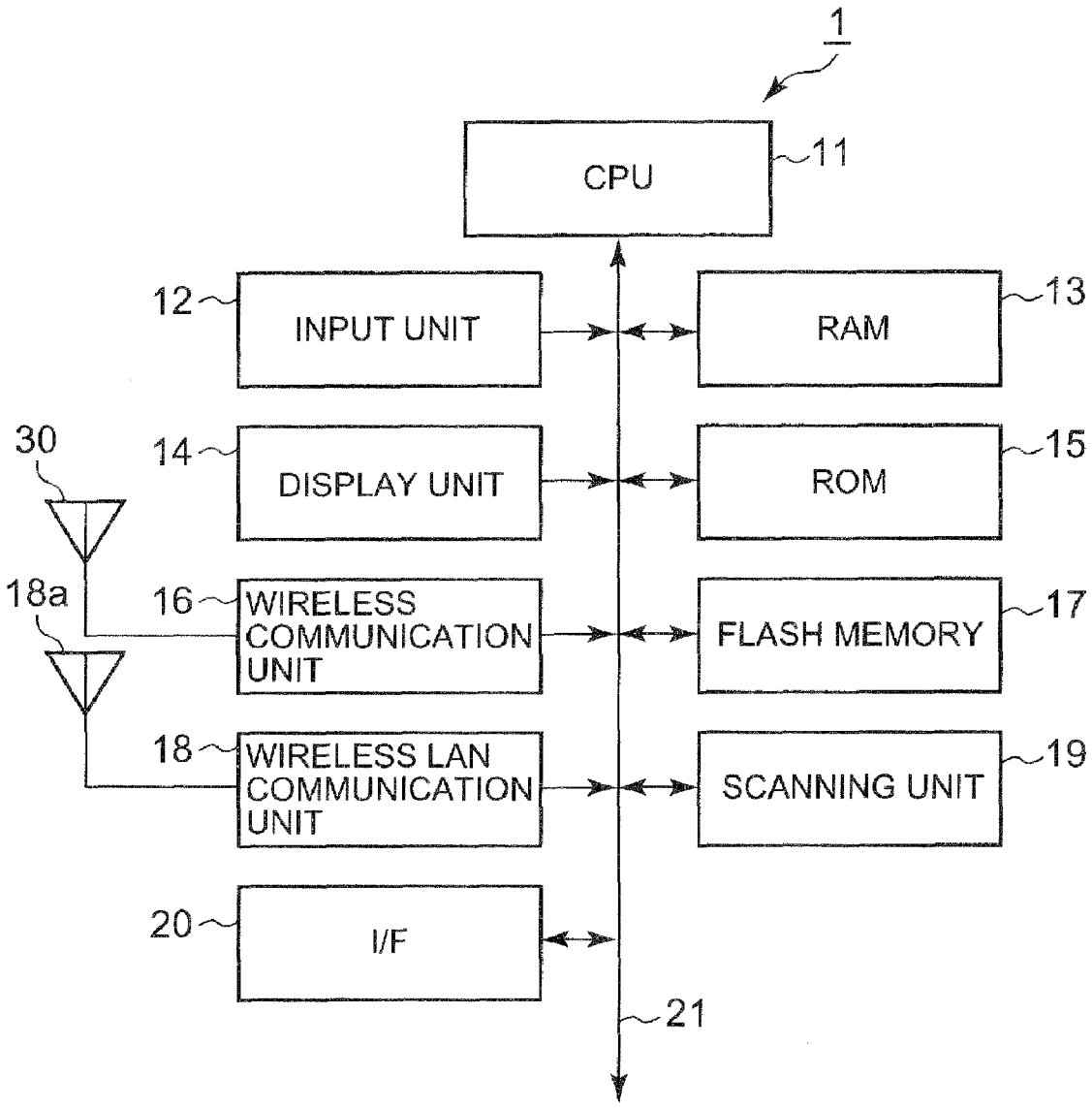
FIG. 3 shows a circuit configuration of the handy terminal.

FIG. 3 shows a circuit configuration of the handy terminal 1.

As shown in FIG. 3, the handy terminal 1 includes a central processing unit (CPU) 11 as a control unit, an input unit 12, a random access memory (RAM) 13, a display unit 14, a read only memory (ROM) 15, a wireless communication unit 16 as a communication unit having the planar monopole antenna 30, a flash memory 17, a wireless LAN communication unit 18 having an antenna 18*a*, a scanning unit 19, and an I/F (Inter Face) 20. The respective units are connected to one another through a bus 21.

The CPU 11 controls the respective units of the handy terminal 1. The CPU 11 reads out a specified program from the ROM 15 which stores a system program and various application programs, loads the specified program into the RAM 13, and carries out various processing in cooperation with the program loaded into the RAM 13.

In cooperation with the various programs, the CPU 11 accepts an input of operating information through the input unit 12, reads out various information from the ROM 15, reads out and writes various information from and into the flash memory 17. Moreover, the CPU 11 controls the wireless communication unit 16 so that the handy terminal 1 can communicate with an external device through a base station by communicating with the base station via mobile telephone communication using the planar monopole antenna 30. The CPU 11 controls the wireless LAN communication unit 18 so that the handy terminal 1 can communicate with an external device via wireless LAN communication using the antenna 18*a*. The CPU 11 controls the scanning unit 19 to read data of a bar code. The CPU 11 wirelessly communicates with an external device through the I/F 20.

The input unit 12 includes the trigger keys 3A, 3B and various keys 3C, and outputs a key input signal of each key pressed by an operator to the CPU 11. The input unit 12 may be designed to integrate with the display unit 14 so that a touch panel can be formed.

The RAM 13 is a volatile memory for temporarily storing information. The RAM 13 has a working area for temporarily storing various programs executed by the CPU 11 and various data associated with these programs.

The display unit 14 has a display such as liquid crystal display (LCD) and electro luminescent display (ELD). The display unit 14 executes a display processing in accordance with a signal from the CPU 11.

The ROM 15 is a read only storage unit in which various programs and data are stored.

The wireless communication unit 16 is connected to the planar monopole antenna 30. The wireless communication unit 16 sends and receives information to and from an external device using the planar monopole antenna 30 through a base station via mobile telephone communication such as GSM. In the embodiment, the mobile telephone communication uses 824-960 MHz and 1710-1990 MHz to conduct multi-band wireless communication. The planar monopole antenna 30 is designed to match with these frequency bands. The planar monopole antenna 30 and the wireless communication unit 16 may be designed to operate on other frequency bands and use other wireless communication system.

The flash memory 17 is a storage unit from/into which information (various data) can be read out/written.

The wireless LAN communication unit 18 is connected to the antenna 18*a* such as planar monopole antenna. The wireless LAN communication unit 18 sends and receives information to and from an external device using the antenna 18*a* through an access point via wireless LAN communication.

The scanning unit 19 reads a bard code image and outputs the data of the bar code image to the CPU 11.

The I/F 20 sends and receives information to and from an external device through a communication cable. The I/F 20 is a cable communication unit using universal serial bus (USB), for example.

Next, a configuration of the planar monopole antenna 30 will be described with reference to FIG. 4.

Figure 4:
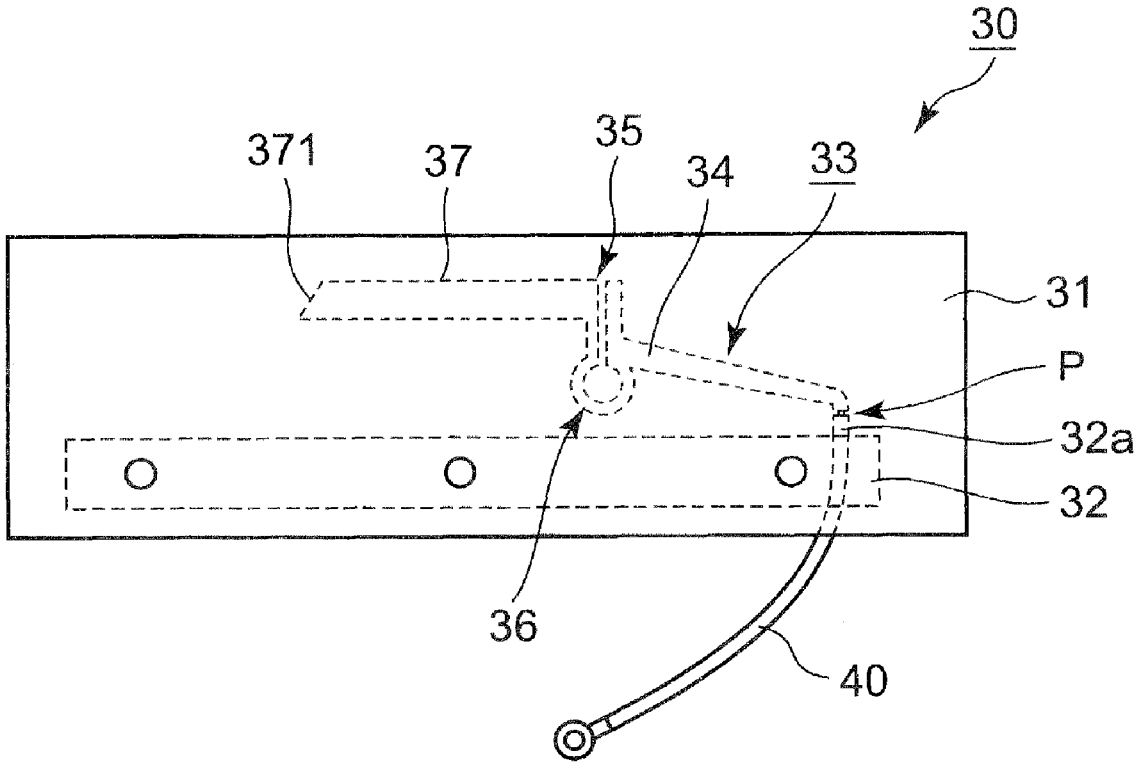
FIG. 4 shows a configuration of a planar monopole antenna according to the embodiment of the present invention.

FIG. 4 shows the configuration of the planar monopole antenna 30.

The planar monopole antenna 30 includes a film 31, a ground section 32 as a ground element, and a monopole section 33 as an antenna element. The monopole section 33 includes a pole section 34 as a first pole element, a capacitor section 35 as a capacitor element, a coil section 36 as a coil element, and a pole section 37 as a second pole element.

The film 31 is a Flexible Print Circuit (FPC) film, and formed of an insulating material such as polyimide. Each of the ground section 32 and the monopole section 33 is formed of a planar body of a conductive material such as copper foil, and wired on the film 31 by printed wiring. The ground section 32 is connected to ground potential. The ground section 32 has a projection 32*a* connected to the coaxial cable 40.

The monopole section 33 is a monopole antenna element. In the monopole section 33, the pole section 34, the capacitor section 35, the coil section 36 and the pole section 37 are formed in this order in an integrated manner. One end of the pole section 34 is connected to the coaxial cable 40. The capacitor section 35 has a gap. A capacitance C of the capacitor section 35 is proportional to a plate area (length Lc) facing the gap of the capacitor section 35. The capacitance C of the capacitor section 35 is inversely proportional to the gap distance.

The coil section 36 has a looped single-turn coil. As a coil diameter of the coil section 36 increases, an inductance L of the coil section 36 also increases. The capacitor section 35 and the coil section 36 function as a trap coil. The pole section 37 is formed into a strip shape with an inclined edge 371 at a tip end of the pole section 37. The pole section 37 is provided in parallel to an upper side (long side) of the ground section 32. The gap of the capacitor section 35 extends perpendicular to the upper side of the ground section 32 over the capacitor section 35.

Next, a connection between the planar monopole antenna 30 and the coaxial cable 40 will be described with reference to FIG. 5.

Figure 5:
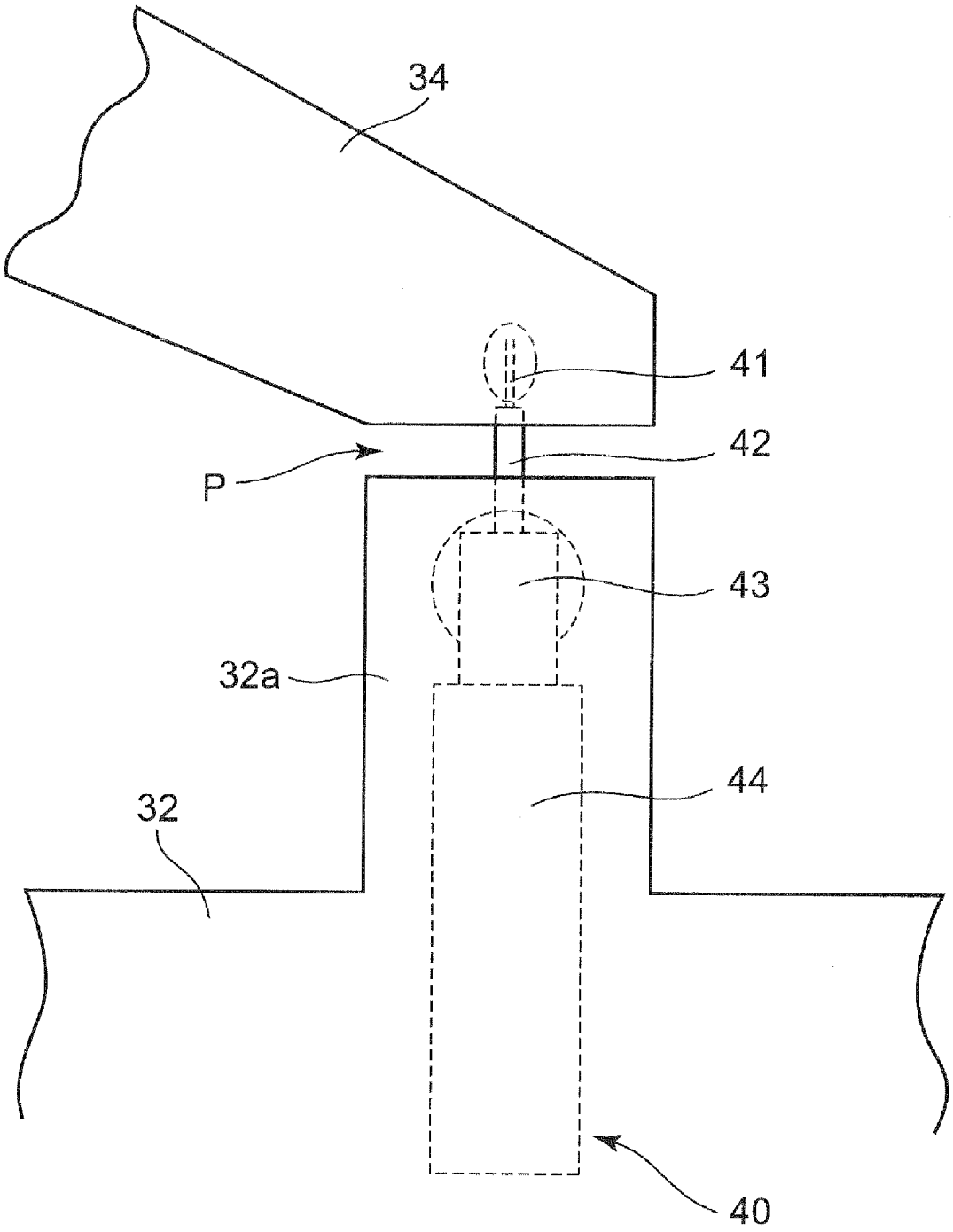
FIG. 5 shows a configuration of a connection between the planar monopole antenna and a coaxial cable.

FIG. 5 shows a configuration of the connection between the planar monopole antenna 30 and the coaxial cable 40. The film 31 is omitted in FIG. 5 for simplicity.

The coaxial cable 40 has a core wire 41 such as a copper wire, an insulating member 42 such as polyethylene member, an external conductor 43, and a protective coating section 44 as an insulating member which are provided in a radial direction in this order outward from a center. The core wire 41 at one end of the coaxial cable 40 is soldered to one end of the pole section 34 of the monopole section 33. The external conductor 43 is soldered to the projection 32*a* of the ground section 32. The other end of the coaxial cable 40 is connected to the GSM module 5. At the other end of the coaxial cable 40, the core wire 41 is connected to a terminal of antenna current of the GSM module 5, and the external conductor 43 is connected to a ground of the GSM module 5. The connection part of the planar monopole antenna 30 to the coaxial cable 40 is called as a feeding point.

Next, a principle of a monopole antenna, on which the planar monopole antenna 30 is based, will be described with reference to FIGS. 6, 7A and 7B.

Figure 6:
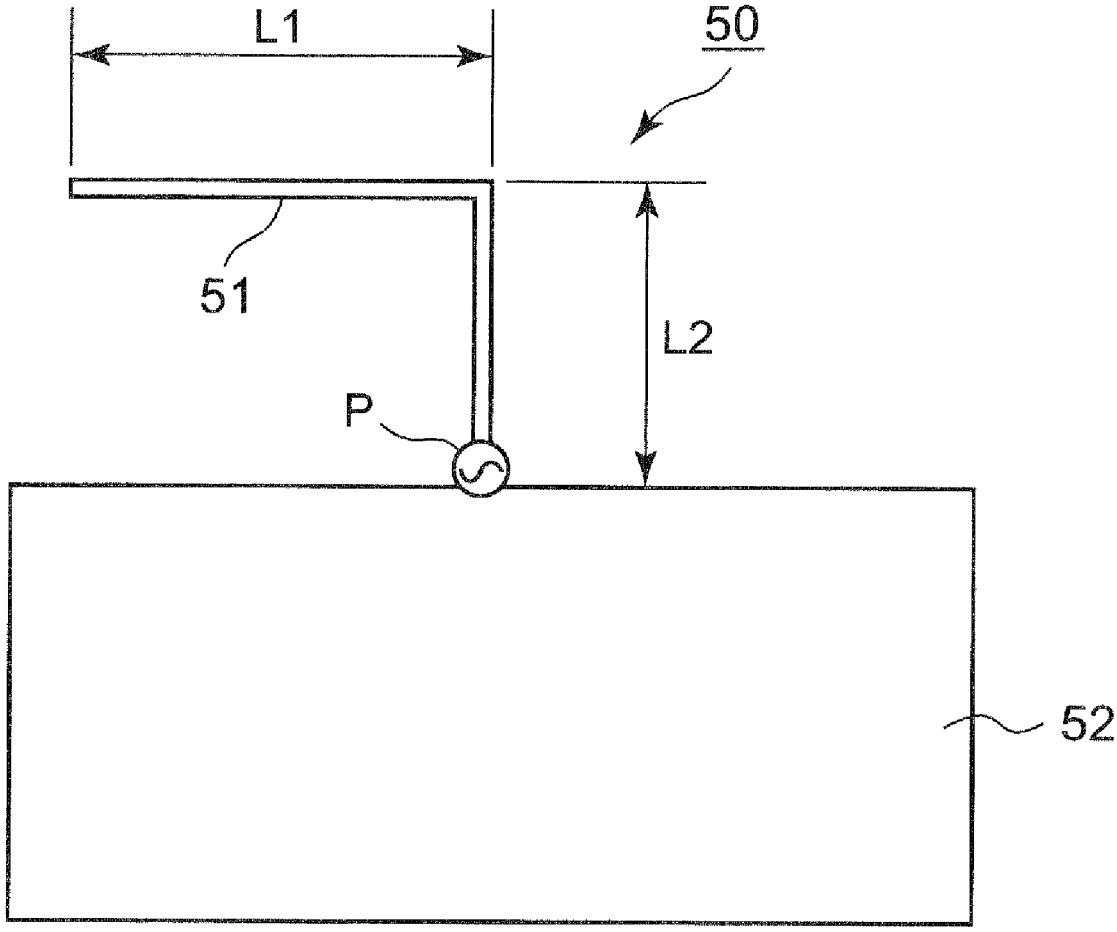
FIG. 6 shows a configuration of a single-band monopole antenna.

FIG. 6 shows a configuration of a single-band monopole antenna 50. FIG. 7A shows an equivalent circuit of a multi-band monopole antenna 60. FIG. 7B shows S parameter characteristics of the monopole antenna 60 with respect to frequency.

As shown in FIG. 6, the single-band monopole antenna 50 has a monopole section 51 bent at a right angle, and a ground section 52. The monopole antenna 50 is connected to a coaxial cable at a feeding point P as in the case of FIG. 5. In the monopole section 51, length of a parallel part which is parallel to the ground section 52 is denoted by L1, and length of a perpendicular part which is orthogonal to the ground section 52 is denoted by L2.

Assuming that a radio wavelength in wireless communication (wavelength of a resonance frequency) is denoted by $\lambda$, the entire length (L1+L2) of the monopole section 51 is set to $\lambda/4$ so as to resonate with the radio wave in wireless communication. If the monopole section 51 is sandwiched by dielectric members such as plastic, rubber, or ceramic members (dielectric constant is $\in$), the entire length (L1+L2) is shortened by $1/(\in)^{-1/2}$ times.

Since impedance of the feeding point P is inversely proportional to a distance between the ground section 52 and the parallel part of the monopole section 51, the distance L2 is set so that the impedance of the feeding point P matches with impedance of an output terminal of a transmitter (GSM module 5). If one half of the monopole section 51 is bent at a right angle to the remaining half as in the case of the monopole antenna 50, the impedance is set to about 50[Ω]. Given that the impedance is set to 50[Ω] as described above, if the length L2 of the perpendicular part of the monopole section 51 is set to $\lambda/8$ or more, influence of bending pole can be reduced, which is desirable. The resonance frequency band of the monopole section 51 is only the frequency $\lambda$ band.

Figure 7A:
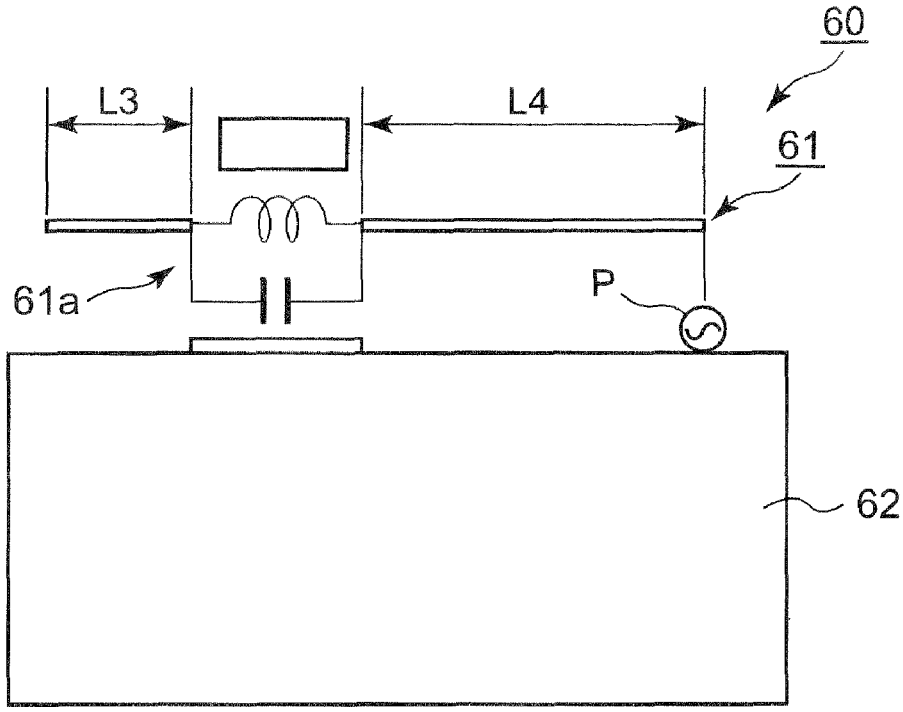
FIG. 7A shows an equivalent circuit of a multi-band monopole antenna.

The planar monopole antenna 30 shown in FIG. 4 is equivalent to the multi-band monopole antenna 60 shown in FIG. 7A. The monopole antenna 60 includes a monopole section 61 bent at a right angle, and a ground section 62. The monopole section 61 has a parallel resonance circuit 61*a* at a halfway point of the monopole section 61 between two pole elements of the monopole section 61. The two pole elements are parallel to the ground section 62. In the parallel resonance circuit 61*a*, a capacitor and a coil are connected to the monopole section 61 in parallel. Length of one of the pole elements on a tip end side of the monopole section 61 is denoted by L3, and length of the other of the pole elements on the feeding point P side is denoted by L4.

Figure 7B:
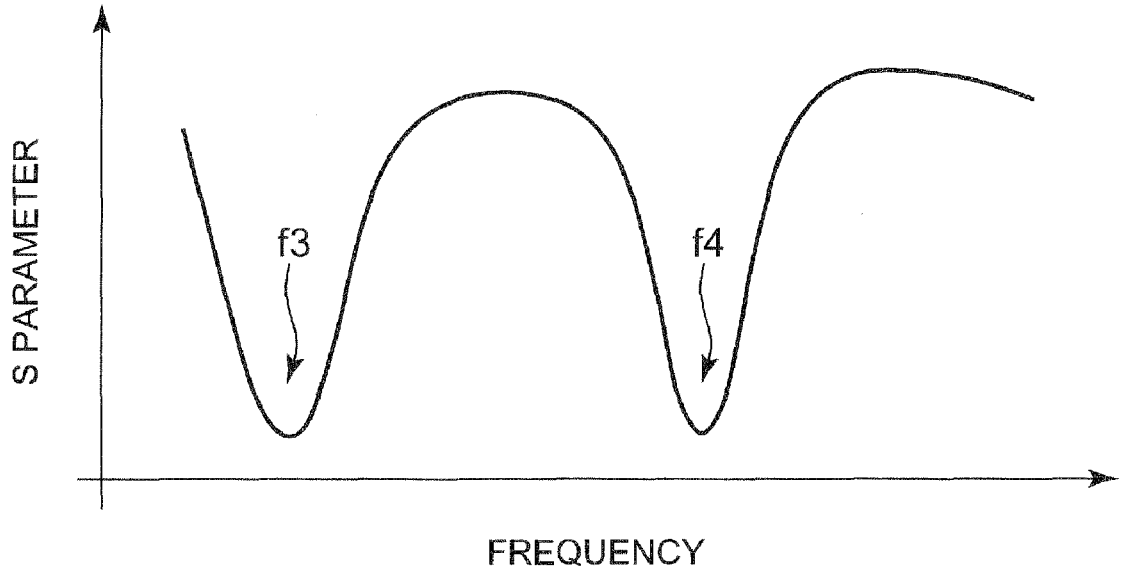
FIG. 7B shows S parameter characteristics of a monopole antenna with respect to frequency.

As shown in FIG. 7B, in the S parameter characteristics of the monopole antenna 60 with respect to frequency, resonance occurs at frequencies f3 and f4. The S parameter is a numeral value representing a relationship between incident wave and reflected wave. The resonance occurs at lower values of S parameter. At a high frequency band, because one pole element of length L3 is disconnected from the rest of the monopole section 61 according to impedance, the resonance occurs at a frequency f4 corresponding to the length L4 of the other pole element. At a low frequency band, because the impedance of the parallel resonance circuit 61*a* is lowered, the resonance occurs at a frequency f3 corresponding to the entire length (L3+L4) of the pole elements. According to this principle, the multi-band monopole antenna 60 can resonate with two frequencies: one resonance point corresponds to the length of one of the pole elements on the feeding point P side; and the other resonance point corresponds to the entire length of the pole elements.

Figure 8:
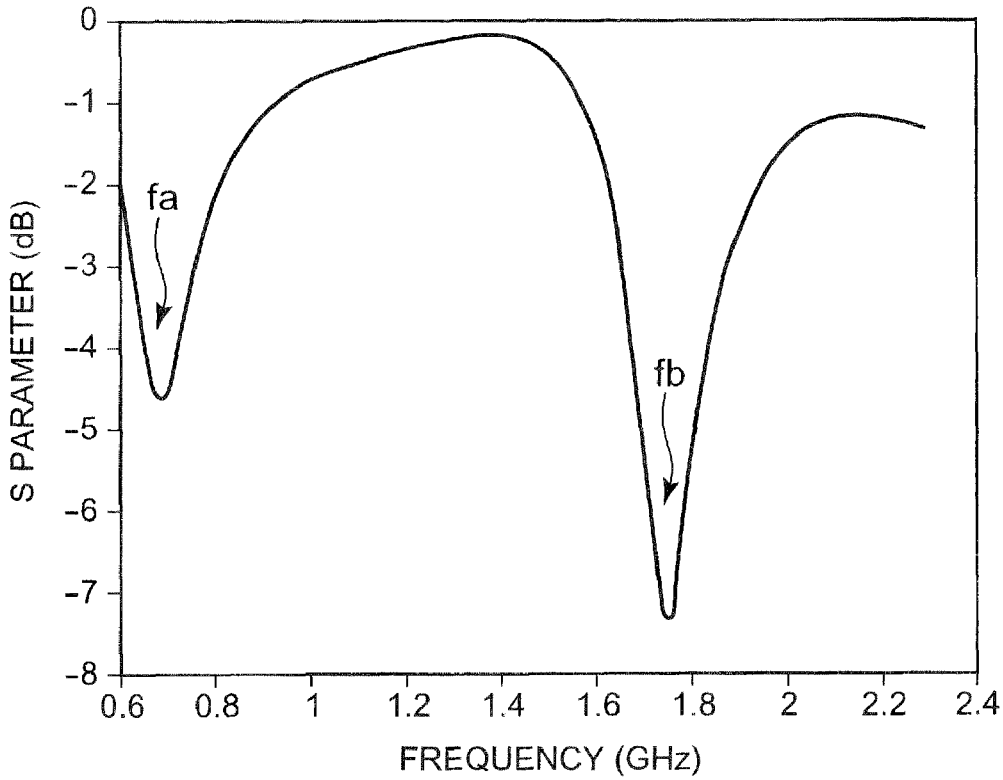
FIG. 8 shows S parameter characteristics of the planar monopole antenna with respect to frequency according to the embodiment of the present invention.

FIG. 8 shows S parameter characteristics of the planar monopole antenna 30 with respect to frequency.

In the planar monopole antenna 30 of the embodiment, the capacitor section 35 and the coil section 36 correspond to the parallel resonance circuit 61*a* of the monopole antenna 60. Therefore, the planar monopole antenna 30 functions as a multi-band antenna which resonates with two frequencies: one corresponds to the entire length of the pole sections 34 and 37 of the monopole section 33 (≈ length of the monopole section 33 in a direction parallel to the ground section 32); and the other corresponds to the length of the pole section 34.

As shown in FIG. 8, in the S parameter characteristics of the planar monopole antenna 30 with respect to frequency, resonance occurs at two frequency bands fa and fb: the frequency fa corresponds to the entire length of the pole sections 34 and 37; and the frequency fb corresponds to the length of the pole section 34.

Moreover, since the pole section 37 has the inclined edge 371, resonance occurs in connection with length of the longest side of the pole section 37 and length of a diagonal in the pole section 37. Therefore, a resonance frequency band at a low frequency band corresponding to the length of the pole section 37 can be broadened.

Furthermore, the impedance of the feeding point P in the planar monopole antenna 30 can be changed if the distance between the monopole section 33 and the ground section 32 is changed. For example, as an angle between the upper side of the ground section 32 and the pole section 34 increases, the distance between the monopole section 33 and the ground section 32 increases, and thus the impedance of the feeding point P also increases. On the other hand, as the angle between the upper side of the ground section 32 and the pole section 34 decreases, the distance between the monopole section 33 and the ground section 32 decreases, and thus the impedance of the feeding point P is lowered.

Next, characteristics of another planar monopole antenna in which positions of the capacitor section 35 and the coil section 36 of the planar monopole antenna 30 are changed will be described with reference to FIGS. 9 and 10.

Figure 9:
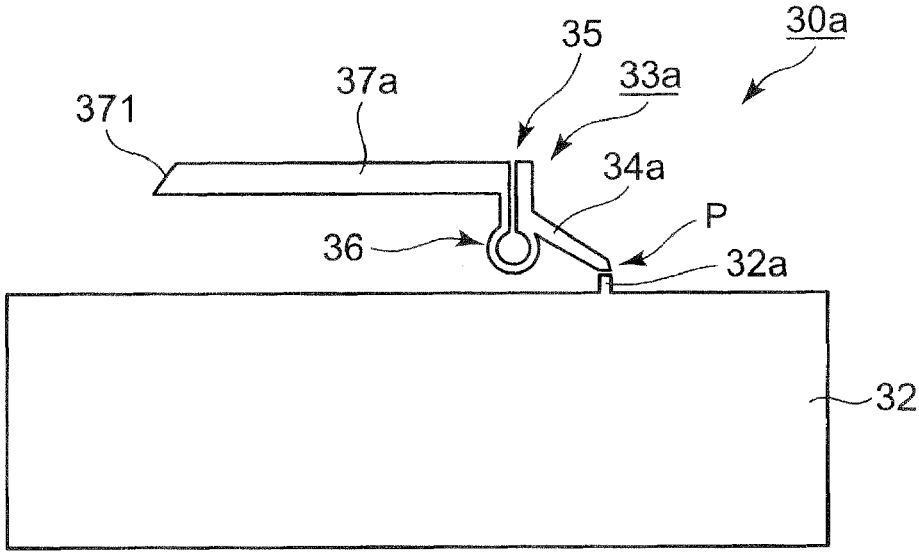
FIG. 9 shows a configuration of another planar monopole antenna according to the embodiment of the present invention.

FIG. 9 shows a configuration of a planar monopole antenna 30*a*. FIG. 10 shows S parameter characteristics of the planar monopole antenna 30*a* with respect to frequency.

The planar monopole antenna 30*a* shown in FIG. 9 is designed so that the capacitor section 35 and the coil section 36 are provided closer to the feeding point P than those of the planar monopole antenna 30 shown in FIG. 4. The planar monopole antenna 30*a* includes the film 31 (which is omitted in FIG. 9), the ground section 32, and a monopole section 33*a* made of a conductive material. In the monopole section 33*a*, a pole section 34*a*, the capacitor section 35, the coil section 36 and a pole section 37*a* are formed in this order in an integrated manner.

In the planar monopole antenna 30*a*, length of the monopole section 33*a* in a direction parallel to the upper side of the ground section 32 (length of the pole sections 34*a* and 37*a*) is equal to the length of the monopole section 33 in a direction parallel to the upper side of the ground section 32 (length of the pole sections 34 and 37) in the planar monopole antenna 30. However, the length of the pole section 34*a* in the planar monopole antenna 30*a* is shorter than that of the pole section 34 in the planar monopole antenna 30.

Figure 10:
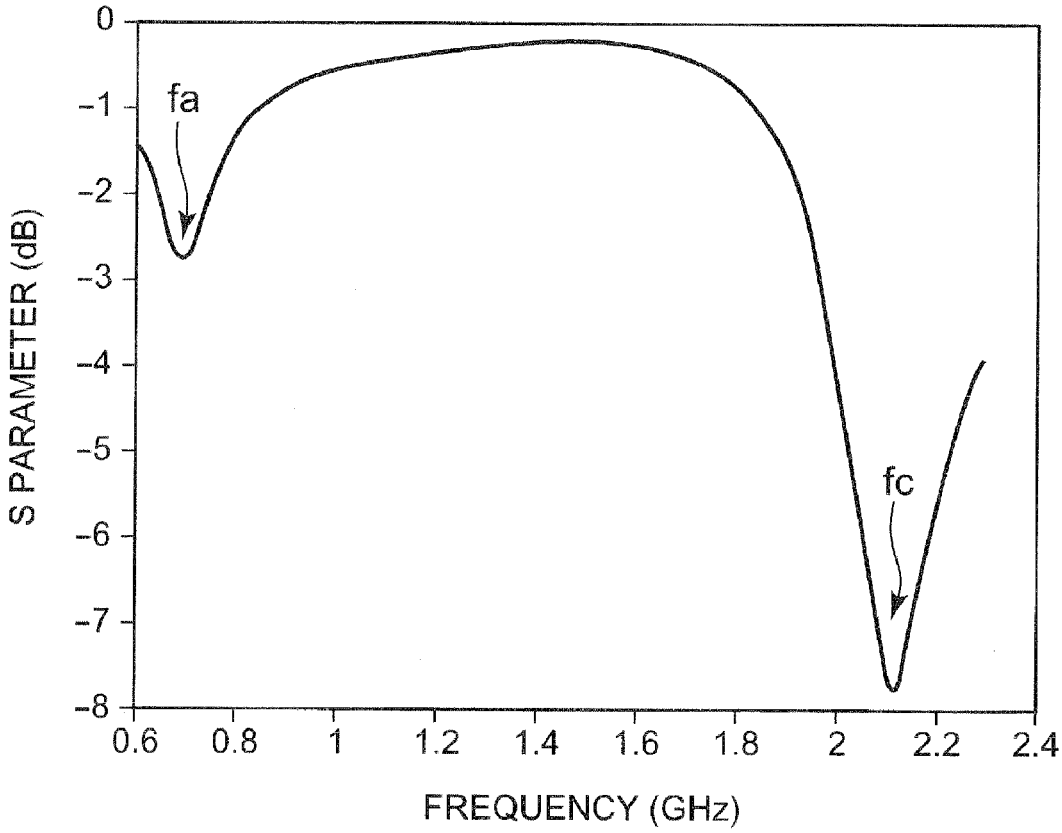
FIG. 10 shows S parameter characteristics of another planar monopole antenna with respect to frequency according to the embodiment of the present invention.

Comparing the S parameter characteristics of the planar monopole antenna 30*a* with respect to frequency shown in FIG. 10 and the S parameter characteristics of the planar monopole antenna 30 shown in FIG. 8, resonance frequencies of the planar monopole antenna 30*a* and the planar monopole antenna 30 at a low frequency band are both equal to frequency fa. At a high frequency band, on the other hand, a resonance frequency of the planar monopole antenna 30*a* is fc which is higher than the frequency fb of the planar monopole antenna 30. Therefore, a resonance frequency at a high frequency band can be varied by changing the positions of the capacitor section 35 and the coil section 36.

According to the embodiment, the planar monopole antenna 30 includes the film 31, the planar monopole section 33 which is a planar conductor on the film 31, and the planar ground section 32 which is a planar conductor on the film 31. The monopole section 33 includes the pole section 34 having the feeding point P, the capacitor section 35, the coil section 36 and the pole section 37, and these sections are formed in this order in an integrated manner. As described above, the planar monopole antenna 30 is designed as a film antenna, and the monopole section 33 does not need a plurality of antenna elements. Moreover, no trap coil is provided as an additional component. This may allow to easily manufacture the planar monopole antenna 30 in a small size as a multi-band antenna.

In addition, because the monopole section 33 can be designed as a single antenna element, it is not necessary to provide a plurality of antenna elements in parallel to the ground section 32. Therefore, a change in impedance due to a difference in resonance frequency can be reduced. Thus, appropriate impedance matching can be obtained.

Furthermore, since the pole section 37 of the monopole section 33 has the inclined edge 371, a resonance frequency band at a low frequency band can be broadened.

In the planar monopole antenna 30, the length of the pole section 34 corresponds to the resonance frequency at a high frequency band, and the length of the monopole section 33 corresponds to the resonance frequency at a low frequency band. Therefore, the length of the pole section 34 and the entire length of the monopole section 33 are adjusted so as to design the planar monopole antenna 30 that matches with desired resonance frequencies.

The handy terminal 1 is provided with the planar monopole antenna 30 having the advantage described above. Therefore, it is possible to provide the handy terminal 1 in a small size that allows multi-band communication.

(First Modification)

Figure 11:
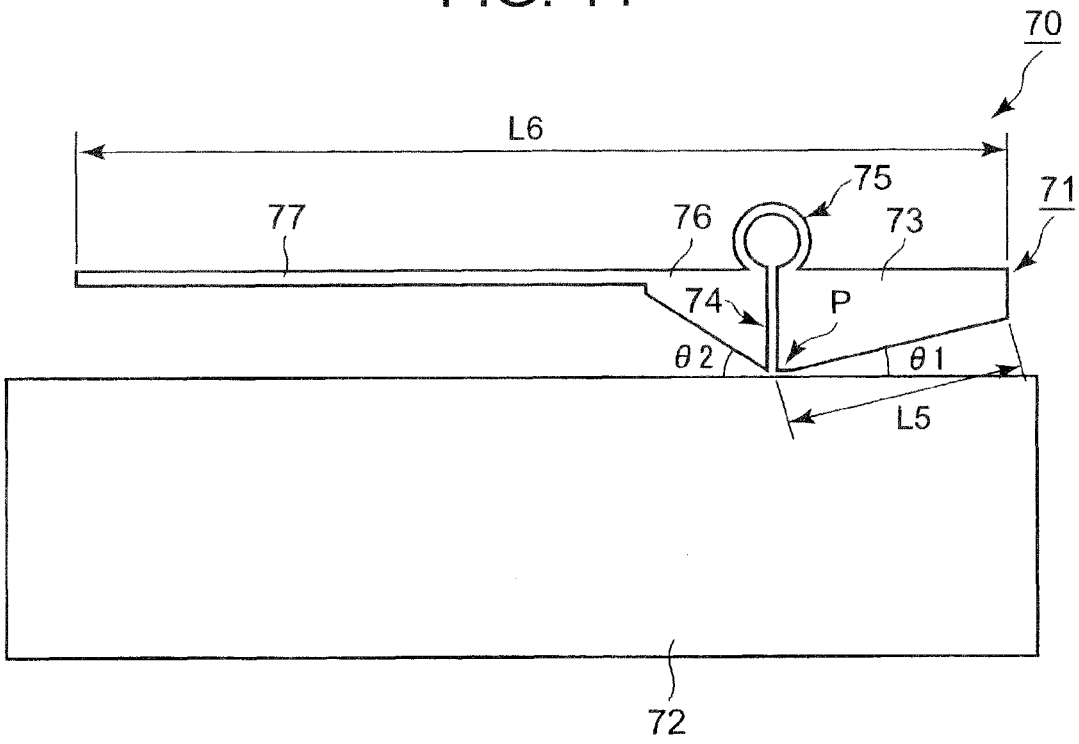
FIG. 11 shows a configuration of a planar monopole antenna according to a first modification of the embodiment of the present invention.

A firs modification of the above-described embodiment will be described with reference to FIG. 11. FIG. 11 shows a configuration of a planar monopole antenna 70.

In the first modification, the planar monopole antenna 70 is provided in the handy terminal 1 of the above-described embodiment in place of the planar monopole antenna 30. As shown in FIG. 11, the planar monopole antenna 70 includes the film 31 (which is omitted in FIG. 11) formed of an insulating material such as polyimide, and a monopole section 71 and a ground section 72, each of which is formed of a conductive material such as copper foil and formed on the film 31. In the monopole section 71, a trapezoidal pole section 73, a coil section 75, a trapezoidal pole section 76, and a strip-shaped pole section 77 are formed in this order in an integrated manner.

A capacitor section 74 is formed by a combination of the pole section 73 and pole section 76 so as to have a gap therebetween. A feeding point P connected to the coaxial cable 40 is set at the lower end of the pole section 73 and the ground section 72. The pole section 77 is provided in parallel to the upper side (long side) of the ground section 72. The gap of the capacitor section 74 extends perpendicular to the upper side of the ground section 72 over the capacitor section 74.

Suppose that an angle between a lower side of the pole section 73 and the upper side of the ground section 72 is θ1; length of the lower side of the pole section 73 is L5; an angle between a lower side of the pole section 76 and the upper side of the ground section 72 is θ2; and the entire length of the monopole section 71 (length of the pole sections 73, 76 and 77) parallel to the upper side of the ground section 72 of the planar monopole antenna 70 is L6.

In the planar monopole antenna 70, resonance occurs in connection with the lower side of the pole section 73 (length L5). That is, the pole section 73 functions separated from the rest of the monopole section 71 at a high frequency band. Assuming that wavelength of a resonance frequency is λ1, L5 is defined as length corresponding to λ1/4. Moreover, impedance of the feeding point P at a high frequency band can be changed by changing the angle θ1. In general, since most transmitters and coaxial cables have impedance of 50[Ω], the angle θ1 is set so as to match with this impedance.

In the planar monopole antenna 70, at a low frequency band, resonance occurs in connection with the entire length (upper side) (length L6) of the monopole section 71. Assuming that wavelength of a resonance frequency is λ2, the length L6 is defined as length corresponding to λ2/4. At a low frequency band, because impedance of a trap coil having the capacitor section 74 and the coil section 75 is lowered and the high-frequency effect is reduced, resonance occurs in connection with the sum of the length of both sides of the trap coil in the monopole section 71. Moreover, impedance of the feeding point P at a low frequency band can be changed by changing the angle θ2. In general, since most transmitters and coaxial cables have impedance of 50[Ω], the angle θ2 is set so as to match with this impedance.

According to the first modification, as with the planar monopole antenna 30 of the above-described embodiment, it is possible to realize the planar monopole antenna 70 as a small-size easily-manufactured multi-band antenna that allows appropriate impedance matching.

In the planar monopole antenna 70, the length L5 of the lower side of the pole section 73 corresponds to a resonance frequency at a high-frequency band, and the entire length L6 of the monopole section 71 corresponds to a resonance frequency at a low frequency band. Therefore, it is possible to design the planar monopole antenna 70 that matches with desired resonance frequencies by adjusting the length L5 of the lower side of the pole section 73 and the entire length L6 of the monopole section 71.

The angle θ1 is formed between the pole section 73 and the upper side of the ground section 72. The impedance of the feeding point P at a high frequency band can be set by adjusting the angle θ1 to design the planar monopole antenna 70.

The angle θ2 is formed between the pole section 76 and the upper side of the ground section 72. The impedance of the feeding point P at a low frequency band can be set by adjusting the angle θ2 to design the planar monopole antenna 70.

(Second Modification)

Figure 12:
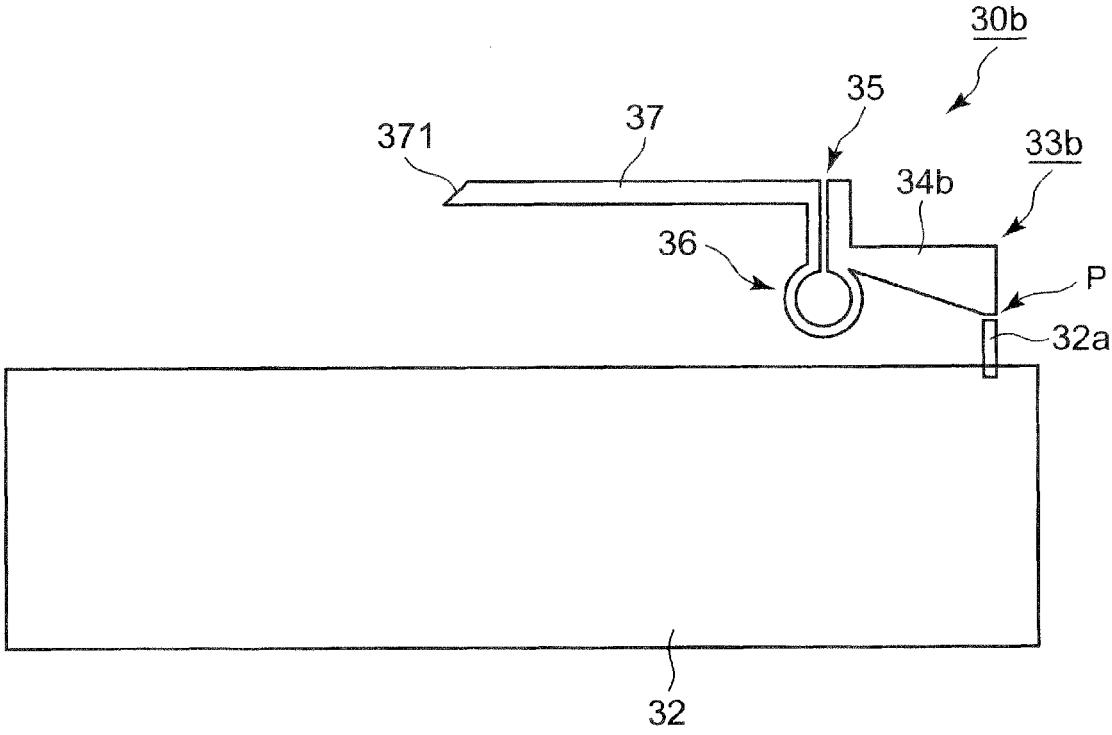
FIG. 12 shows a configuration of a planar monopole antenna according to a second modification of the embodiment of the present invention.

A second modification of the above-described embodiment will be described with reference to FIG. 12. FIG. 12 shows a configuration of a planar monopole antenna 30*b*.

In the second modification, the planar monopole antenna 30*b* is provided in the handy terminal 1 according to the above-described embodiment in place of the planar monopole antenna 30. As shown in FIG. 12, the planar monopole antenna 30*b* includes the film 31 (which is omitted in FIG. 12) formed of an insulating material such as polyimide, and a monopole section 33*b* and the ground section 32, each of which is formed of a conductive material such as copper foil and formed on the film 31. In the monopole section 33*b*, a trapezoidal pole section 34*b*, the capacitor section 35, the coil section 36 and the pole section 37 are formed in this order in an integrated manner. An upper side of the pole section 34*b* is provided in parallel to the upper side of the ground section 32.

According to the second modification, it is possible to realize the planar monopole antenna 30*b* that has the same advantage as the planar monopole antenna 30 of the above-described embodiment.

(Third Modification)

A third modification of the above-described embodiment will be described with reference to FIGS. 13A and 13B.

Figure 13A:
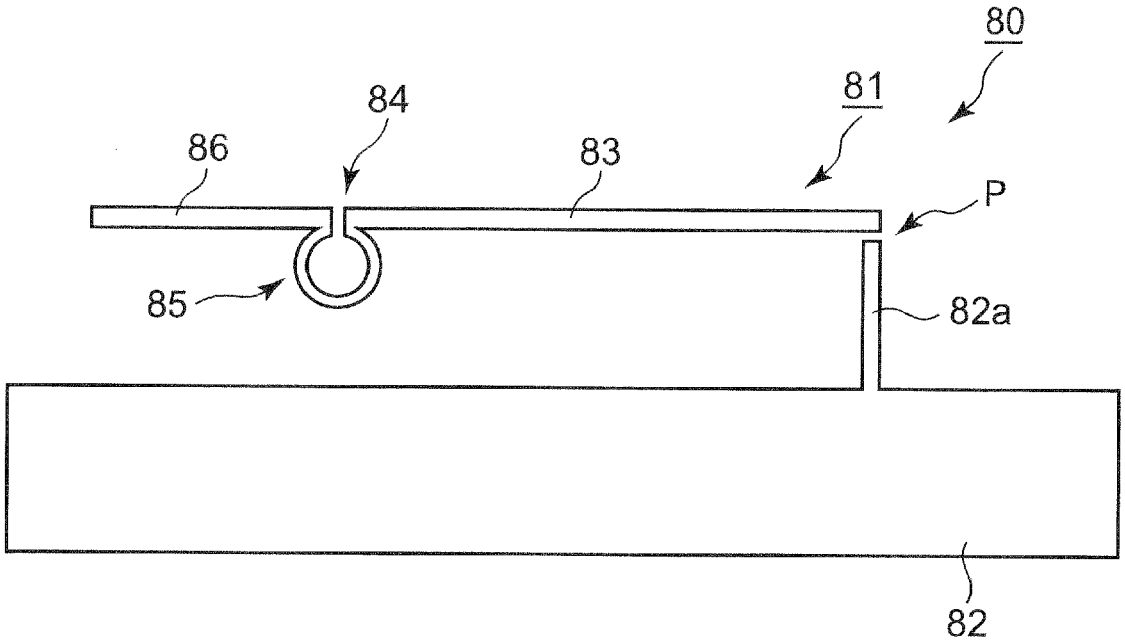
FIG. 13A shows a configuration of a planar monopole antenna according to a third modification of the embodiment of the present invention.
Figure 13B:
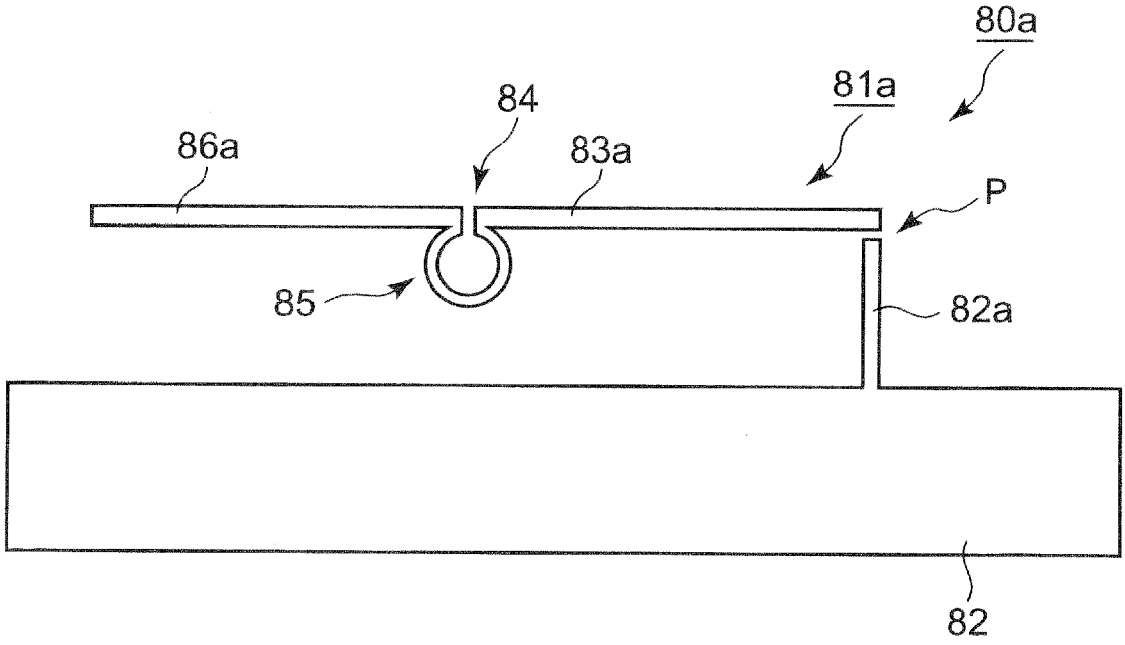
FIG. 13B shows a configuration of another planar monopole antenna according to the third modification.

FIG. 13A shows a configuration of a planar monopole antenna 80. FIG. 13B shows a configuration of a planar monopole antenna 80*a*.

In this modification, the planar monopole antenna 80 is provided in place of the planar monopole antenna 30 in the handy terminal 1 of the above-described embodiment. As shown in FIG. 13A, the planar monopole antenna 80 includes the film 31 (which is omitted in FIG. 13A) formed of an insulating material such as polyimide, and a monopole section 81 and a ground section 82, each of which is formed of a conductive material such as copper foil and formed on the film 31. In the monopole section 81, a strip-shaped pole section 83, a coil section 85 and a strip-shaped pole section 86 are formed in this order in an integrated manner.

A capacitor section 84 is formed by a combination of the pole section 83 and the pole section 86 so as to have a gap therebetween. The ground section 82 has a projection 82*a*. A feeding point P connected to the coaxial cable 40 is set at a lower end of the pole section 83 and the projection 82*a* of the ground section 82. The pole sections 83 and 86 are provided in parallel to the upper side of the ground section 82. The gap of the capacitor section 84 extends perpendicular to the upper side of the ground section 82 over the capacitor section 84.

In the planar monopole antenna 80, a resonance frequency at a low frequency band corresponds to the entire length of the monopole section 81 (i.e., the length in a direction parallel to the upper side of the ground section 82). A resonance frequency at a high frequency band corresponds to length of the pole section 83 (i.e., the length in a direction parallel to the upper side of the ground section 82).

Next, a configuration of the planar monopole antenna 80*a* will be explained with reference to FIG. 13B. The entire length of a monopole section 81*a* of the planar monopole antenna 80*a* is the same as that of the monopole section 81 of the planar monopole antenna 80 shown in FIG. 13A, whereas length of a pole section 83*a* of the planar monopole antenna 80*a* is different from that of the pole section 83 of the planar monopole antenna 80. As shown in FIG. 13B, the planar monopole antenna 80*a* includes the film 31 (which is omitted in FIG. 13B) formed of an insulating material such as polyimide, and a monopole section 81*a* and the ground section 82, each of which is formed of a conductive material and formed on the film 31. In the monopole section 81*a*, a strip-shaped pole section 83*a*, the coil section 85 and a pole section 86*a* are formed in this order in an integrated manner. The pole sections 83*a* and 86*a* are provided in parallel to the upper side of the ground section 82.

At a low frequency band, resonance frequency of the planar monopole antenna 80*a* is the same as that of the planar monopole antenna 80. At a high frequency band, on the other hand, resonance frequency of the planar monopole antenna 80*a* is higher than that of the planar monopole antenna 80 because (length of the pole section 83*a*)<(length of the pole section 83).

According to this modification, as with the planar monopole antenna 30 of the above-described embodiment, it is possible to realize the planar monopole antenna 80 as a small-size easily-manufactured multi-band antenna that allows appropriate impedance matching.

In the planar monopole antenna 80, the length of the pole section 83 corresponds to the resonance frequency at a high frequency band, and the length of the monopole section 81 corresponds to the resonance frequency at a low frequency band. Therefore, the length of the pole section 83 and the entire length of the monopole section 81 are adjusted so as to design the planar monopole antenna 80 that matches with desired resonance frequencies.

(Fourth Modification)

A fourth modification of the above-described embodiment will be described with reference to FIG. 14.

Figure 14:
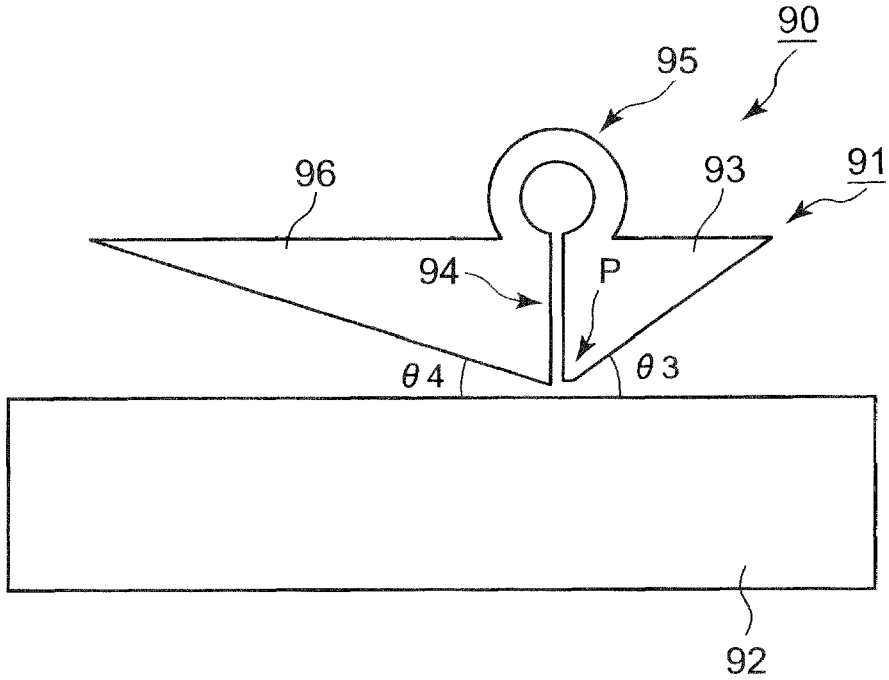
FIG. 14 shows a configuration of a planar monopole antenna according to a fourth modification of the embodiment of the present invention.

FIG. 14 shows a configuration of a planar monopole antenna 90.

In this modification, the planar monopole antenna 90 is provided in place of the planar monopole antenna 30 in the handy terminal 1 of the above-described embodiment. As shown in FIG. 14, the planar monopole antenna 90 includes the film 31 (which is omitted in FIG. 14) formed of an insulating material such as polyimide, and a monopole section 91 and a ground section 92, each of which is formed of a conductive material such as copper foil and formed on the film 31. In the monopole section 91, a triangular pole section 93, a coil section 95 and a triangular pole section 96 are formed in this order in an integrated manner.

A capacitor section 94 is formed by a combination of the pole section 93 and the pole section 96 so as to have a gap therebetween. A feeding point P connected to the coaxial cable 40 is set at a lower end of the pole section 93 and the ground section 92. Upper sides of the pole sections 93 and 96 are provided in parallel to an upper side of the ground section 92. The gap of the capacitor section 94 extends perpendicular to the upper side of the ground section 92 over the capacitor section 94.

An angle θ3 is formed between the pole section 93 and the upper side of the ground section 92. An angle θ4 is formed between the pole section 96 and the upper side of the ground section 92. By adjusting the angle θ3, impedance of the feeding point P at a high frequency band can be set. By adjusting the angle θ4, impedance of the feeding point P at a low frequency band can be set.

According to this modification, it is possible to realize the planar monopole antenna 90 as a multi-band antenna that has the same advantage as the planar monopole antenna 70 of the first modification. It should be noted that the adjustment of the angles θ3 and θ4 of the planar monopole antenna 90 has an impact on the impedance control of the feeding point P more than the adjustment of the angles θ1 and θ2 of the planar monopole antenna 70.

(Fifth Modification)

A fifth modification of the above-described embodiment will be described with reference to FIG. 15.

Figure 15:
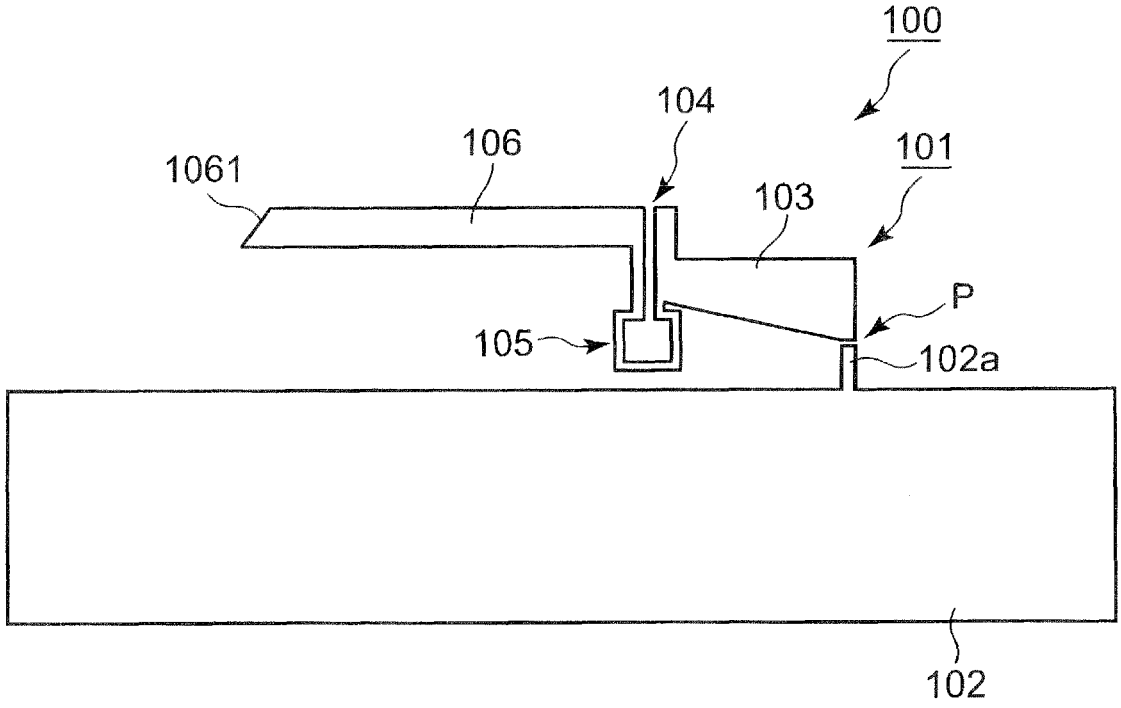
FIG. 15 shows a configuration of a planar monopole antenna according to a fifth modification of the embodiment of the present invention.

FIG. 15 shows a configuration of a planar monopole antenna 100.

In this modification, the planar monopole antenna 100 is provided in place of the planar monopole antenna 30 in the handy terminal 1 of the above-described embodiment. As shown in FIG. 15, the planar monopole antenna 100 includes the film 31 (which is omitted in FIG. 15) formed of an insulating material such as polyimide, and a monopole section 101 and a ground section 102, each of which is formed of a conductive material such as copper foil and formed on the film 31. In the monopole section 101, a trapezoidal pole section 103, a capacitor section 104, a square coil section 105 and a strip-shaped pole section 106 are formed in this order in an integrated manner.

The ground section 102 has a projection 102*a*. A feeding point P connected to the coaxial cable 40 is set at a lower end of the pole section 103 and the projection 102*a* of the ground section 102. The pole section 106 has an inclined edge 1061 at a tip end thereof. Upper sides of the pole sections 106 and 103 are provided in parallel to the upper side of the ground section 102. The capacitor section 104 has a gap extending perpendicular to the upper side of the ground section 102 over the capacitor section 104.

According to this modification, it is possible to realize the planar monopole antenna 100 that has the same advantage as the planar monopole antenna 30 of the above-described embodiment.

Moreover, since the coil section 105 is formed into a square shape instead of a loop, the coil section 105 can easily be formed.

(Sixth Modification)

A sixth modification of the above-described embodiment will be described with reference to FIGS. 16 and 17.

Figure 16:
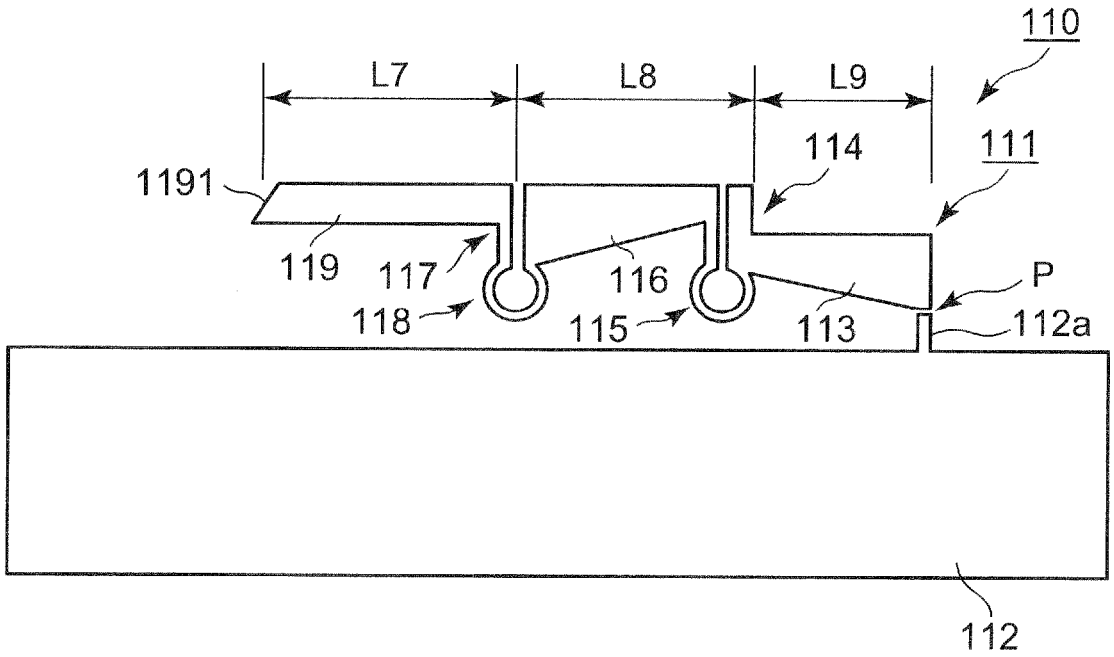
FIG. 16 shows a configuration of a planar monopole antenna according to a sixth modification of the embodiment of the present invention.

FIG. 16 shows a configuration of a planar monopole antenna 110. FIG. 17 shows S parameter characteristics of the planar monopole antenna 110 with respect to frequency.

In this modification, the planar monopole antenna 110 is provided in place of the planar monopole antenna 30 in the handy terminal 1 of the above-described embodiment. As shown in FIG. 16, the planar monopole antenna 110 includes the film 31 (which is omitted in FIG. 16) formed of an insulating material such as polyimide, and a monopole section 111 and a ground section 112, each of which is formed of a conductive material such as copper foil and formed on the film 31. In the monopole section 111, a trapezoidal pole section 113, a capacitor section 114, a circular coil section 115, a trapezoidal pole section 116, a capacitor section 117, a circular coil section 118 and a strip-shaped pole section 119 are formed in this order in an integrated manner.

The pole section 116 is designed to contain the capacitor section 117. The ground section 112 has a projection 112*a*. A feeding point P connected to the coaxial cable 40 is set at a lower end of the pole section 113 and the projection 112*a* of the ground section 112. The pole section 119 has an inclined edge 1191 at a tip end thereof. Upper sides of the pole sections 119, 113 and 116 are provided in parallel to an upper side of the ground section 112. Each of the capacitor sections 114 and 117 has a gap extending perpendicular to the upper side of the ground section 112.

Suppose that length of the pole section 113 in a direction parallel to the upper side of the ground section 112 is L9; length of the capacitor section 114 and the pole section 116 in a direction parallel to the upper side of the ground section 112 is L8; length of the pole section 119 in a direction parallel to the upper side of the ground section 112 is L7; and the entire length of the monopole section 111 in a direction parallel to the upper side of the ground section 112 is (L7+L8+L9).

Figure 17:
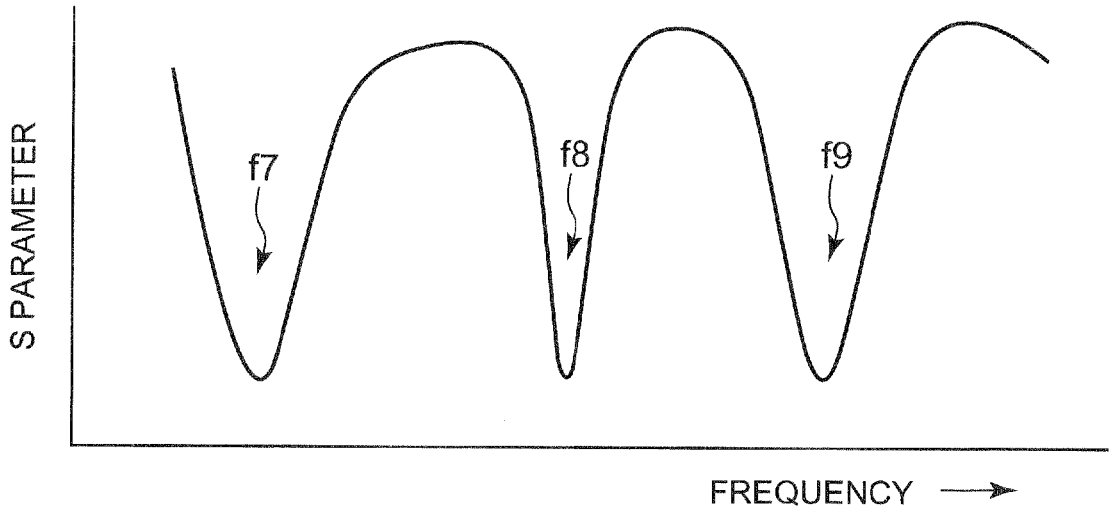
FIG. 17 shows S parameter characteristics of the planar monopole antenna with respect to frequency according to the sixth modification.

According to the S parameter characteristics of the planar monopole antenna 110 with respect to frequency shown in FIG. 17, resonance occurs at three frequency bands of a frequency f7, a frequency f8 and a frequency f9. At a high frequency band, the resonance occurs at the frequency f9 corresponding to the length L9. At an intermediate frequency band, the resonance occurs at the frequency f8 corresponding to the length (L8+L9). At a low frequency band, the resonance occurs at the frequency f7 corresponding to the length (L7+L8+L9) as the entire element length. In accordance with this principle, it is possible to realize the planar monopole antenna 110 as a multi-band monopole antenna that can resonate with three frequencies.

According to this modification, as with the planar monopole antenna 30 of the above-described embodiment, it is possible to realize the planar monopole antenna 110 as a small-size easily-manufactured multi-band antenna that allows appropriate impedance matching and allows to broaden a resonance frequency band at a low frequency band.

In addition, because the planar monopole antenna 110 includes two trap coils (i.e., one is the capacitor section 114 and the coil section 115; and the other is the capacitor section 117 and the coil section 118), it is possible to realize the multi-band planar monopole antenna 110 having three resonance frequency bands.

In the planar monopole antenna 110, the length L9 of the pole section 113 corresponds to the resonance frequency at a high frequency band, the length (L8+L9) corresponds to the resonance frequency at an intermediate frequency band, and the length (L7+L8+L9) of the monopole section 111 corresponds to the resonance frequency at a low frequency band. Therefore, the length of the pole sections 113, the length of the pole section 116 and the entire length of the monopole section 111 are adjusted so as to design the planar monopole antenna 110 that matches with desired resonance frequencies.

In this modification, three resonance frequencies can be obtained by two combinations of a capacitor section and a coil section. Those skilled in the art will appreciate that three or more combinations of a capacitor section and a coil section may be employed.

(Seventh Modification)

A seventh modification of the above-described embodiment will be described with reference to FIG. 18.

Figure 18:
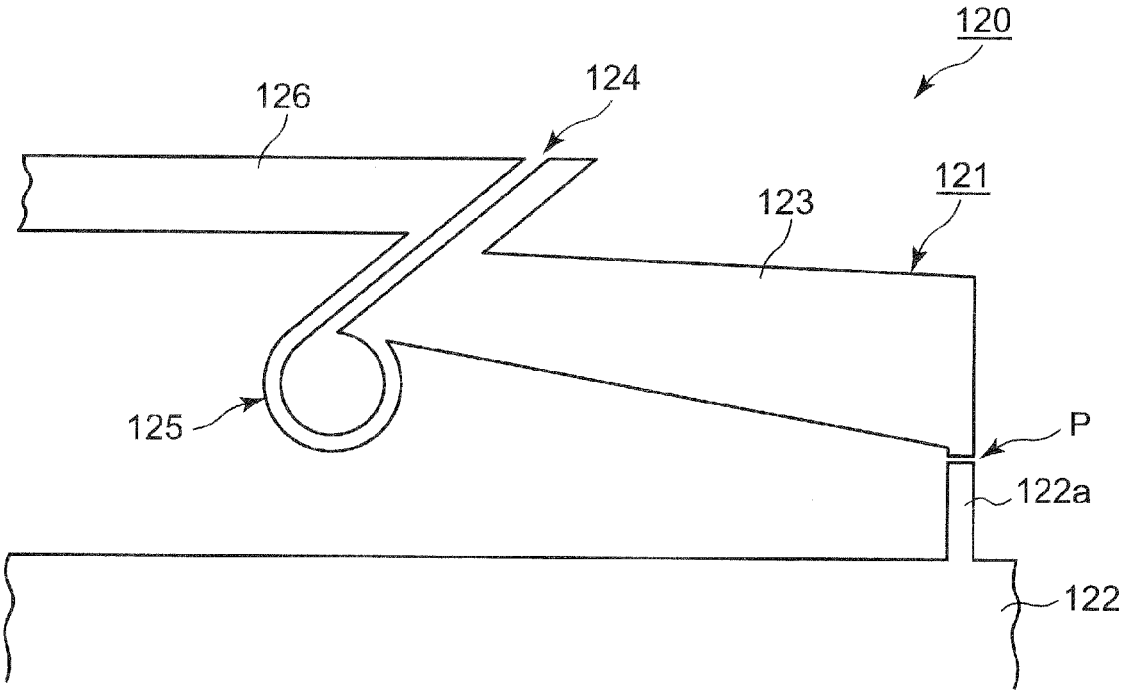
FIG. 18 shows a configuration of a planar monopole antenna according to a seventh modification of the embodiment of the present invention.

FIG. 18 shows a configuration of a planar monopole antenna 120.

In this modification, the planar monopole antenna 120 is provided in place of the planar monopole antenna 30 in the handy terminal 1 of the above-described embodiment. As shown in FIG. 18, the planar monopole antenna 120 includes the film 31 (which is omitted in FIG. 18) formed of an insulating material such as polyimide, and a monopole section 121 and a ground section 122, each of which is formed of an conductive material such as copper foil and formed on the film 31. In the monopole section 121, a trapezoidal pole section 123, a capacitor section 124, a circular coil section 125 and a strip-shaped pole section 126 are formed in this order in an integrated manner.

The ground section 122 has a projection 122*a*. A feeding point P connected to the coaxial cable 40 is set at a lower end of the pole section 123 and the projection 122*a* of the ground section 122. Upper sides of the pole section 126 and the pole section 123 are provided in parallel to an upper side of the ground section 122.

The capacitor section 124 has a gap which is inclined with respect to the upper side of the ground section 122. Accordingly, because a surface area (length) of the gap of the capacitor section 124 can be larger than that of a capacitor section having a gap extending perpendicular to the upper side of the ground section 122, the capacitor section 124 has larger capacitance C.

According to this modification, as with the planar monopole antenna 30 of the above-described embodiment, it is possible to realize the planar monopole antenna 120 as a small-size easily-manufactured multi-band antenna that allows appropriate impedance matching.

Furthermore, because the capacitor section 124 has the gap which is inclined with respect to the upper side of the ground section 122, the capacitance C of the capacitor section 124 can be increased.

(Eighth Modification)

An eighth modification of the above-described embodiment will be described with reference to FIG. 19.

Figure 19:
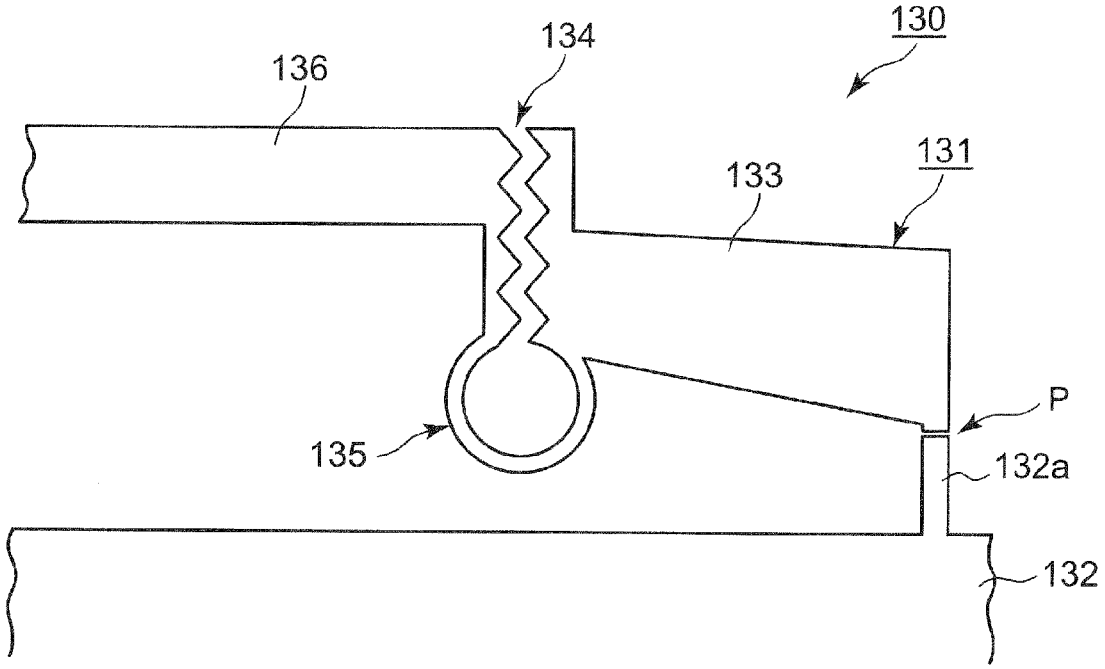
FIG. 19 shows a configuration of a planar monopole antenna according to an eighth modification of the embodiment of the present invention.

FIG. 19 shows a configuration of a planar monopole antenna 130.

In this modification, the planar monopole antenna 130 is provided in place of the planar monopole antenna 30 in the handy terminal 1 of the above-described embodiment. As shown in FIG. 19, the planar monopole antenna 130 includes the film 31 (which is omitted in FIG. 19) formed of an insulating material such as polyimide, and a monopole section 131 and a ground section 132, each of which is formed of a conductive material such as copper foil and formed on the film 31. In the monopole section 131, a trapezoidal pole section 133, a capacitor section 134, a circular coil section 135 and a strip-shaped pole section 136 are formed in this order in an integrated manner.

The ground section 132 has a projection 132*a*. A feeding point P connected to the coaxial cable 40 is set at a lower end of the pole section 133 and the projection 132*a* of the ground section 132. Upper sides of the pole section 136 and the pole section 133 are provided in parallel to an upper side of the ground section 132.

The capacitor section 134 has a zigzag gap whose gap distance is uniform over the capacitor section 134 and which extends perpendicular to the upper side of the ground section 132. Because a surface area (length) of the gap of the capacitor section 134 is larger than that of a capacitor section having a linear gap whose gap distance is uniform over the capacitor section, the capacitor section 134 has larger capacitance C.

According to this modification, as with the planar monopole antenna 30 of the above-described embodiment, it is possible to realize the planar monopole antenna 130 as a small-size easily-manufactured multi-band antenna that allows appropriate impedance matching.

Furthermore, because the capacitor section 134 has the zigzag gap with a uniform distance, the capacitance C of the capacitor section 134 can be increased.

(Ninth Modification)

A ninth modification of the above-described embodiment will be described with reference to FIG. 20.

Figure 20:
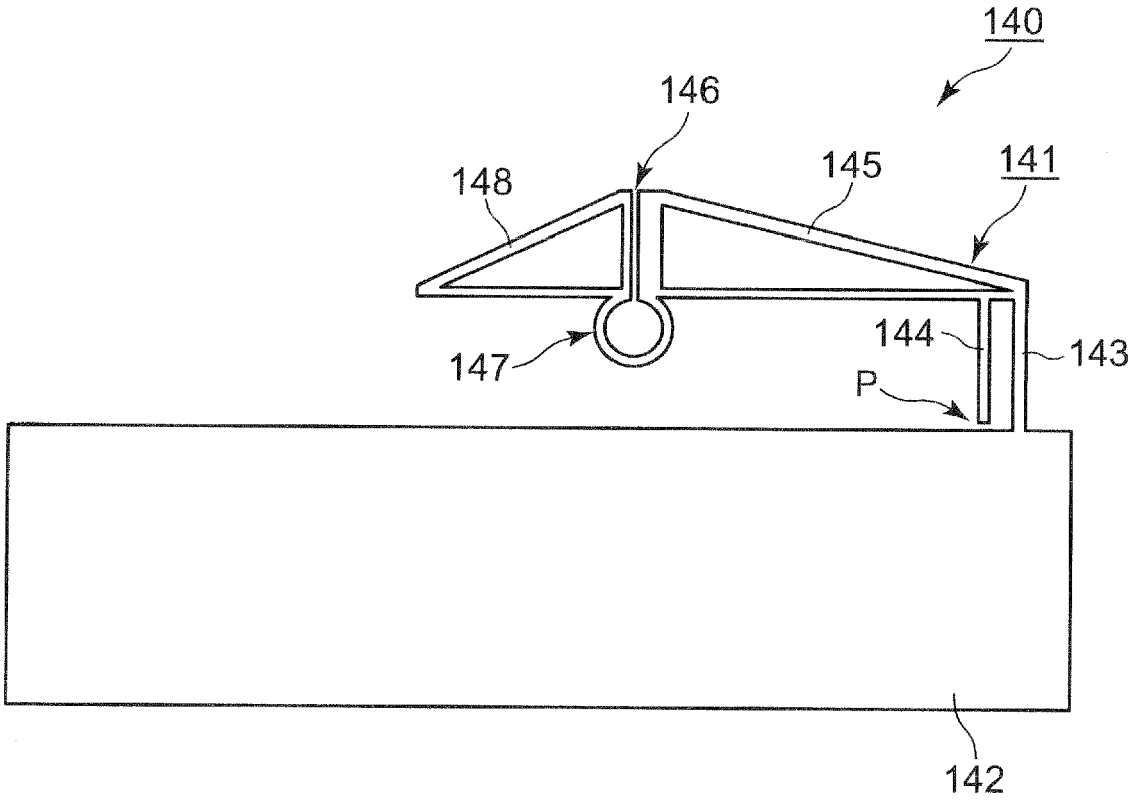
FIG. 20 shows a configuration of a planar monopole antenna according to a ninth modification of the embodiment of the present invention.

FIG. 20 shows a configuration of a planar monopole antenna 140.

In this modification, the planar monopole antenna 140 is provided in place of the planar monopole antenna 30 in the handy terminal 1 of the above-described embodiment. As shown in FIG. 20, the planar monopole antenna 140 includes the film 31 (which is omitted in FIG. 20) formed of an insulating material such as polyimide, and a monopole section 141 and a ground section 142, each of which is formed of a conductive material such as copper foil and formed on the film 31. The monopole section 141 and the ground section 142 are formed in an integrated manner. In the monopole section 141, a strip-shaped pole section 143, a strip-shaped pole section 144, a pole section 145 formed by a triangular outer frame, a circular coil section 147 and a pole section 148 formed by a triangular outer frame are formed in an integrated manner.

The ground section 142 is connected to the pole section 143 in an integrated manner. A capacitor section 146 is formed by a combination of the pole section 145 and the pole section 148 so as to have a gap therebetween. A feeding point P connected to the coaxial cable 40 is set at a lower end of the pole section 144 and the ground section 142. Lower sides of the pole sections 145 and 148 are provided in parallel to an upper side of the ground section 142. The gap of the capacitor section 146 extends perpendicular to the upper side of the ground section 142 over the capacitor section 146.

Antenna current tends to flow at an outer portion (skin) of a monopole section by skin effect. Therefore, even if each of the pole sections 145 and 148 is formed only by an outer frame, antenna performance is less affected by whether a pole section of a monopole section is formed only by an outer frame.

The pole section 143 is provided perpendicular to the upper side of the ground section 142, and the pole section 144 is provided in parallel to the pole section 143. With this structure, a loop is formed by the pole section 144, the pole section 145, the pole section 143, the ground section 142 and the feeding point P.

In general, if a planar monopole antenna is disposed close to a metal portion of a housing of an electronic device such as a handy terminal, impedance is lowered, and thus impedance matching may not be obtained. Therefore, by forming the loop in the planar monopole antenna 140, impedance matching can be obtained. This matching method is used for an inverse F type antenna or the like.

According to this modification, as with the planar monopole antenna 30 of the above-described embodiment, it is possible to realize the planar monopole antenna 140 as a small-size easily-manufactured multi-band antenna that allows appropriate impedance matching.

Furthermore, each of the pole sections 145 and 148 is formed only by an outer frame. With this structure, reduction in weight can be achieved without losing the function of the planar monopole antenna 140 as an antenna.

Still furthermore, the planar monopole antenna 140 has the loop formed by the feeding point P, the pole sections 143, 144, 145 and the ground section 142. With this structure, impedance matching can be obtained.

(Tenth Modification)

A tenth modification of the above-described embodiment will be described with reference to FIGS. 21A and 21B.

Figure 21A:
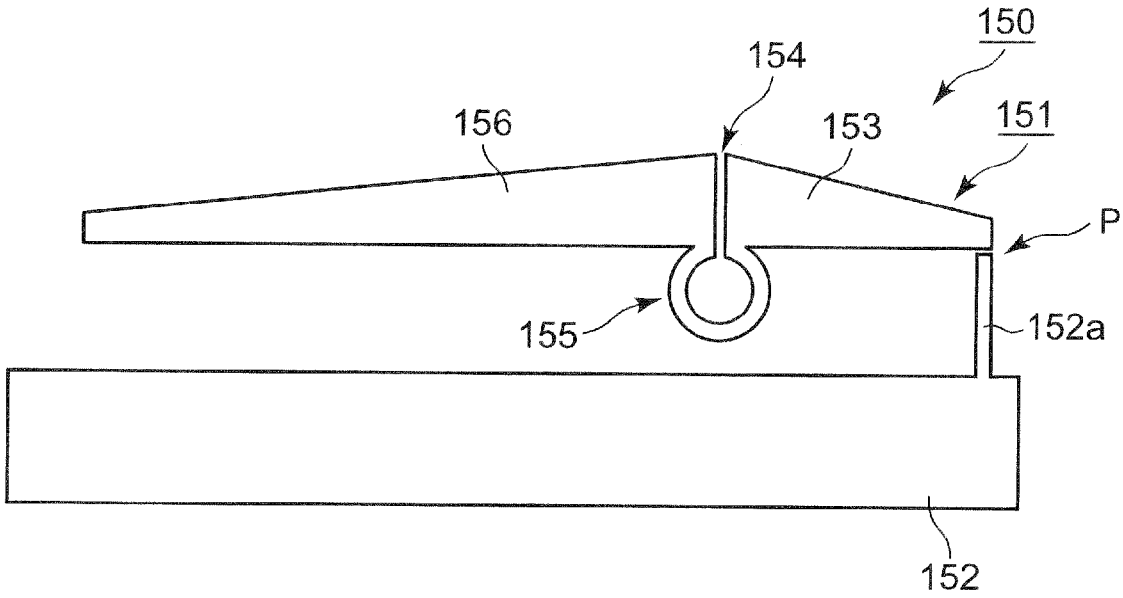
FIG. 21A shows a configuration of a planar monopole antenna according to a tenth modification of the embodiment of the present invention.
Figure 21B:
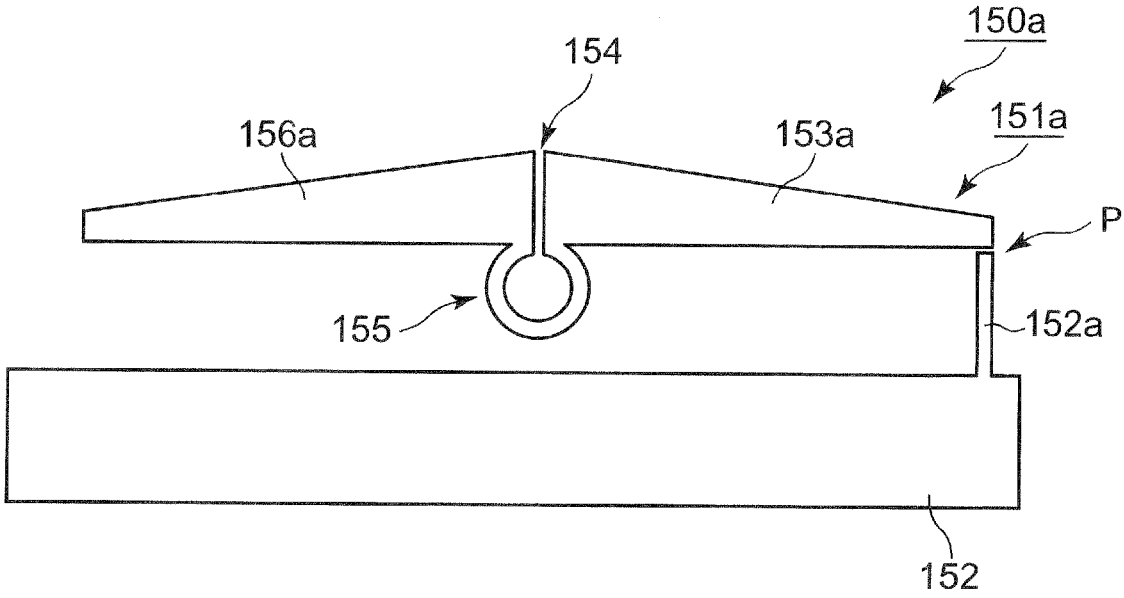
FIG. 21B shows a configuration of another planar monopole antenna according to the tenth modification.

FIG. 21A shows a configuration of a planar monopole antenna 150.

In this modification, the planar monopole antenna 150 is provided in place of the planar monopole antenna 30 in the handy terminal 1 of the above-described embodiment. As shown in FIG. 21A, the planar monopole antenna 150 includes the film 31 (which is omitted in FIG. 21A) formed of an insulating material such as polyimide, and a monopole section 151 and a ground section 152, each of which is formed of a conductive material such as copper foil and formed on the film 31. In the monopole section 151, a trapezoidal pole section 153, a circular coil section 155 and a trapezoidal pole section 156 are formed in this order in an integrated manner.

A capacitor section 154 is formed by a combination of the pole sections 153 and 156 so as to have a gap therebetween. The ground section 152 has a projection 152*a*. A feeding point P connected to the coaxial cable 40 is set at a lower end of the pole section 153 and the projection 152*a* of the ground section 152. Lower sides of the pole sections 153 and 156 are provided in parallel to an upper side of the ground section 152. The gap of the capacitor section 154 extends perpendicular to the upper side of the ground section 152 over the capacitor section 154.

In the planar monopole antenna 150, a resonance frequency at a low frequency band corresponds to the entire length of the monopole section 151 (i.e., the length in a direction parallel to the upper side of the ground section 152). A resonance frequency at a high frequency band corresponds to length of an upper side (oblique line) of the pole section 153.

Next, a configuration of the planar monopole antenna 150*a* will be explained with reference to FIG. 21B. The entire length of a monopole section 151*a* of the planar monopole antenna 150*a* is the same as that of the monopole section 151 of the planar monopole antenna 150 shown in FIG. 21A, whereas length of a pole section 153*a* of the planar monopole antenna 150*a* is different from that of the pole section 153 of the planar monopole antenna 150. As shown in FIG. 21B, the planar monopole antenna 150*a* includes the film 31 (which is omitted in FIG. 21B) formed of an insulating material such as polyimide, and a monopole section 151*a* and the ground section 152, each of which is formed of a conductive material and formed on the film 31. In the monopole section 151*a*, a trapezoidal pole section 153*a*, a coil section 155 and a pole section 156*a* are formed in this order in an integrated manner.

At a low frequency band, resonance frequency of the planar monopole antenna 150*a* is the same as that of the planar monopole antenna 150. At a high frequency band, on the other hand, resonance frequency of the planar monopole antenna 150*a* is lower than that of the planar monopole antenna 150 because (length of the pole section 153*a*)>(length of the pole section 153).

According to this modification, as with the planar monopole antenna 30 of the above-described embodiment, it is possible to realize the planar monopole antenna 150 as a small-size easily-manufactured multi-band antenna that allows appropriate impedance matching.

Furthermore, in the planar monopole antenna 150, the length of the oblique line of the pole section 153 corresponds to the resonance frequency at a high frequency band, and the length of the monopole section 151 corresponds to the resonance frequency at a low frequency band. Therefore, the length of the oblique line of the pole section 153 and the length of the monopole section 151 are adjusted so as to design the planar monopole antenna 150 that matches with desired resonance frequencies.

It should be noted that the planar monopole antennas and the electronic devices in the above-described embodiment and the respective modifications are exemplary and not to be considered limited to what is shown in the drawings and the foregoing detailed description.

In the above-described embodiment and the modifications, the handy terminal has been presented as an electronic device. Other electronic devices may be used in the embodiment and the modifications. Examples of other electronic devices include portable terminals having wireless communication, such as PDA (Personal Digital Assistant), mobile computer and mobile phone.

Any combination of two or more of the embodiment and the modifications may be realized. For example, the pole section 77 of the planar monopole antenna 70 may have an inclined edge at a tip end thereof.

In the above-described embodiment and modifications, the conductive member (the monopole section 33 and ground section 32) is disposed on the film 31 on the GSM module 5 side (inner side) as shown in FIGS. 2A and 2B. The conductive member (the monopole section 33 and ground section 32)

may be disposed on the film 31 on the case 2 side (external side). Furthermore, an arrangement orientation of the planar monopole antenna 30 is not limited to what is shown in FIGS. 2A, 2B and 2C.

With respect to the detailed configurations and operations of the respective elements of the planar monopole antennas and the handy terminals as electronic devices in the above-described embodiment, it will be apparent to those skilled in the art that various modification and variations can be made without departing from the scope of the invention.

The entire disclosure of Japanese Patent Application No. 2007-337533 filed on Dec. 27, 2007 including description, claims, drawings, and abstract are incorporated herein by reference in its entirety.

Although various exemplary embodiments have been shown and described, the invention is not limited to the embodiment shown. Therefore, the scope of the invention is intended to be limited solely by the scope of the claims that follow.

What is claimed is:

1. A planar monopole antenna comprising:

a film formed of an insulating material;

an antenna element which is a single-body planar conductor on the film; and a ground element which is a planar conductor on the film and kept at ground potential, wherein the antenna element includes:

a first element which is formed of a planar body of a conductive material and has a feeding point;

a capacitor element having a capacitor component and a coil element having a coil component, each of which is formed of a planar body of a conductive material and formed integrally with the first element; and a second element which is formed of a planar body of a conductive material and formed integrally with the capacitor element and the coil element;

wherein the first element is formed in a trapezoidal shape, and a side of the trapezoidal shape of the first element forms a predetermined angle with the ground element;

wherein the second element is formed in a trapezoidal shape, and a side of the trapezoidal shape of the second element forms a predetermined angle with the ground element;

wherein the capacitor element is formed by a gap section between the first element and the second element where the first element and the second elements face each other; and wherein the feeding point of the first element is provided near the gap section.

2. The planar monopole antenna according to claim 1, wherein a length of the first element corresponds to a resonance frequency at a high frequency band, and a length of the antenna element corresponds to a resonance frequency at a low frequency band.

3. An electronic device comprising:

an antenna;

a communication unit to perform wireless communication using the antenna; and a control unit to control the communication unit, wherein the antenna is a planar monopole antenna comprising:

a film formed of an insulating material;

an antenna element which is a single-body planar conductor on the film; and a ground element which is a planar conductor on the film and kept at ground potential, wherein the antenna element includes:

a first element which is formed of a planar body of a conductive material and has a feeding point;

a capacitor element having a capacitor component and a coil element having a coil component, each of which is formed of a planar body of a conductive material and formed integrally with the first element; and a second element which is formed of a planar body of a conductive material and formed integrally with the capacitor element and the coil element, wherein the first element is formed in a trapezoidal shape, and a side of the trapezoidal shape of the first element forms a predetermined angle with the ground element, wherein the second element is formed in a trapezoidal shape, and a side of the trapezoidal shape of the second element forms a predetermined angle with the ground element, wherein the capacitor element is formed by a gap section between the first element and the second element where the first element and the second element face each other, and wherein the feeding point of the first element is provided near the gap section.

* * * * *